US007449872B2

(12) United States Patent
Zolfaghari

(10) Patent No.: US 7,449,872 B2
(45) Date of Patent: Nov. 11, 2008

(54) LOW-POWER PROGRAMMABLE LOW-DROP-OUT VOLTAGE REGULATOR SYSTEM

(75) Inventor: Alireza Zolfaghari, Irvine, CA (US)

(73) Assignee: Broadcom Corporation, Irvine, CA (US)

( * ) Notice: Subject to any disclaimer, the term of this patent is extended or adjusted under 35 U.S.C. 154(b) by 242 days.

(21) Appl. No.: 11/214,799

(22) Filed: Aug. 31, 2005

(65) Prior Publication Data

US 2007/0046271 A1 Mar. 1, 2007

(51) Int. Cl.
*G05F 2/16* (2006.01)

(52) U.S. Cl. ..... 323/314; 323/274

(58) Field of Classification Search ..... 323/274, 323/312, 313, 314
See application file for complete search history.

(56) References Cited

U.S. PATENT DOCUMENTS 4,012,688 A * 3/1977 Blackburn et al. ..... 323/354
6,472,857 B1 * 10/2002 Genest et al. ..... 323/303
6,674,273 B2 * 1/2004 Oglesbee ..... 323/284
7,015,680 B2 * 3/2006 Moraveji et al. ..... 323/274
2003/0102851 A1 * 6/2003 Stanescu et al. ..... 323/280
2004/0004468 A1 * 1/2004 Dearn et al. ..... 323/280
2006/0186866 A1 * 8/2006 Sharma ..... 323/282

* cited by examiner

*Primary Examiner*—Shawn Riley
(74) *Attorney, Agent, or Firm*—Sterne Kessler Goldstein & Fox PLLC

(57) ABSTRACT

A low-power programmable low-drop-out voltage regulator system and methods are presented. The regulator includes a local reference generator circuit that receives a voltage input signal and outputs a reference voltage signal, a buffer circuit that receives the reference voltage signal and outputs an output voltage signal, and a comparison device. The comparison device receives and compares the output voltage signal and an accurate reference voltage signal and outputs an adjustment signal to adjust the output voltage signal in the direction of a value of the accurate reference voltage signal. The regulator can include an attenuator circuit to attenuate the reference voltage signal. The output voltage signal can be regulated or programmed by adjusting the gain of the buffer circuit and/or the attenuator circuit. Current consumption can also be programmed by turning on or off one or more amplifier tiers located in the buffer circuit.

28 Claims, 21 Drawing Sheets

LOW-POWER PROGRAMMABLE LOW-DROP-OUT VOLTAGE REGULATOR SYSTEM

BACKGROUND

1. Field

The present invention is related to voltage regulation and control for use in electronic circuits.

2. Related Art

A voltage regulator circuit can provide a fixed and regulated output voltage when the input voltage supply is not constant (i.e., when the input voltage supply varies or fluctuates). A 1.5V voltage regulator can provide a fixed 1.5V supply when the input changes from 3V to 5V, for example. Voltage regulation is essential for systems that require a fixed and well-defined supply voltage while the input voltage supply (e.g., a battery) fluctuates, has ripples, is variable, and/or is noisy. In a conventional 1.5V voltage regulator, for example, the input voltage supply needs to be at least 1.5V higher than the desired output voltage of 1.5V (i.e., the input voltage supply needs to be at least 3V). In some applications, however, the input voltage supply can drop to values as low as 1.7V, causing variation in the output voltage.

Other important concerns include maintaining low power and current consumption and minimizing die area used. The accuracy of a voltage regulator is mainly determined by its bandgap circuit, or local reference generator circuit, although some inaccuracy can be attributed to its buffer circuit as well. For very good accuracy, the bandgap circuit needs to be large and/or consume higher power.

Therefore, what is needed is a low-power low-drop-out voltage regulator that uses a small die area and is capable of keeping power and current consumption low while maintaining accuracy and stability.

SUMMARY

A low-power programmable low-drop-out voltage regulator system and methods are presented. The low-power programmable low-drop-out voltage regulator (LDO) includes a local reference generator circuit, a buffer circuit, and a comparison device. The local reference generator receives a voltage input signal and outputs a reference voltage signal. The buffer circuit receives the reference voltage signal and outputs an output voltage signal. The comparison device receives the output voltage signal and an accurate reference voltage signal, compares the output voltage signal and the accurate reference voltage signal, and outputs an adjustment signal to adjust the output voltage signal in the direction of a value of the accurate reference voltage signal. The accurate reference voltage signal can come from an accurate reference voltage source that is located on the same chip as the LDO or can be located off-chip.

In an embodiment of the present invention, the LDO can include an attenuator circuit to attenuate the reference voltage signal. The output voltage signal can be regulated or programmed by adjusting the gain of the buffer circuit and/or the attenuator circuit. For example, if the output voltage signal has a value lower than the accurate reference voltage signal, then the gain of the buffer circuit can be adjusted by adjusting the resistors in the buffer circuit, thereby bringing the output voltage signal closer to the accurate reference voltage signal. As an alternative example, if the output voltage signal has a value higher than the accurate reference voltage signal, then the gain of the buffer circuit and/or the attenuator circuit can be adjusted by adjusting the resistors in the buffer circuit and/or the attenuator circuit, thereby bringing the output voltage signal closer to the accurate reference voltage signal. Adjusting resistors can include adjusting the resistor values or turning the resistors on or off, for example.

Current consumption can also be adjusted or programmed by turning on or off one or more amplifier tiers located in the buffer circuit of an embodiment of the present invention. Each amplifier tier can include an amplifier device of a differing size, such that various current level modes can be programmed. For example, for a high current at the LDO output, all the tiers can be left on. For a lower current at the LDO output, one or more tiers can be turned off. For an even lower current, one can turn off the tiers with the larger amplifier devices and leave on or turn on tiers with smaller amplifier devices.

One advantage of the LDO as presented herein is its ability to be programmed over a large voltage range. For example, it can be programmed from 0.5 times a nominal output regulated voltage to the nominal output regulated voltage. Another advantage is its ability to trim the output voltage with high accuracy (e.g., 1%) on the nominal output voltage. A third advantage is its ability to be programmed in different output current modes. For example, it can be programmed for a high, medium, or low output current, depending on how much current is needed at the output.

Further embodiments, features, and advantages of the present invention, as well as the structure and operation of the various embodiments of the present invention, are described in detail below with reference to the accompanying drawings.

BRIEF DESCRIPTION OF THE DRAWINGS/FIGURES

The accompanying drawings, which are incorporated herein and form a part of the specification, illustrate one or more embodiments of the present invention and, together with the description, further serve to explain the principles of the invention and to enable a person skilled in the pertinent art(s) to make and use the invention.

Figure 1:
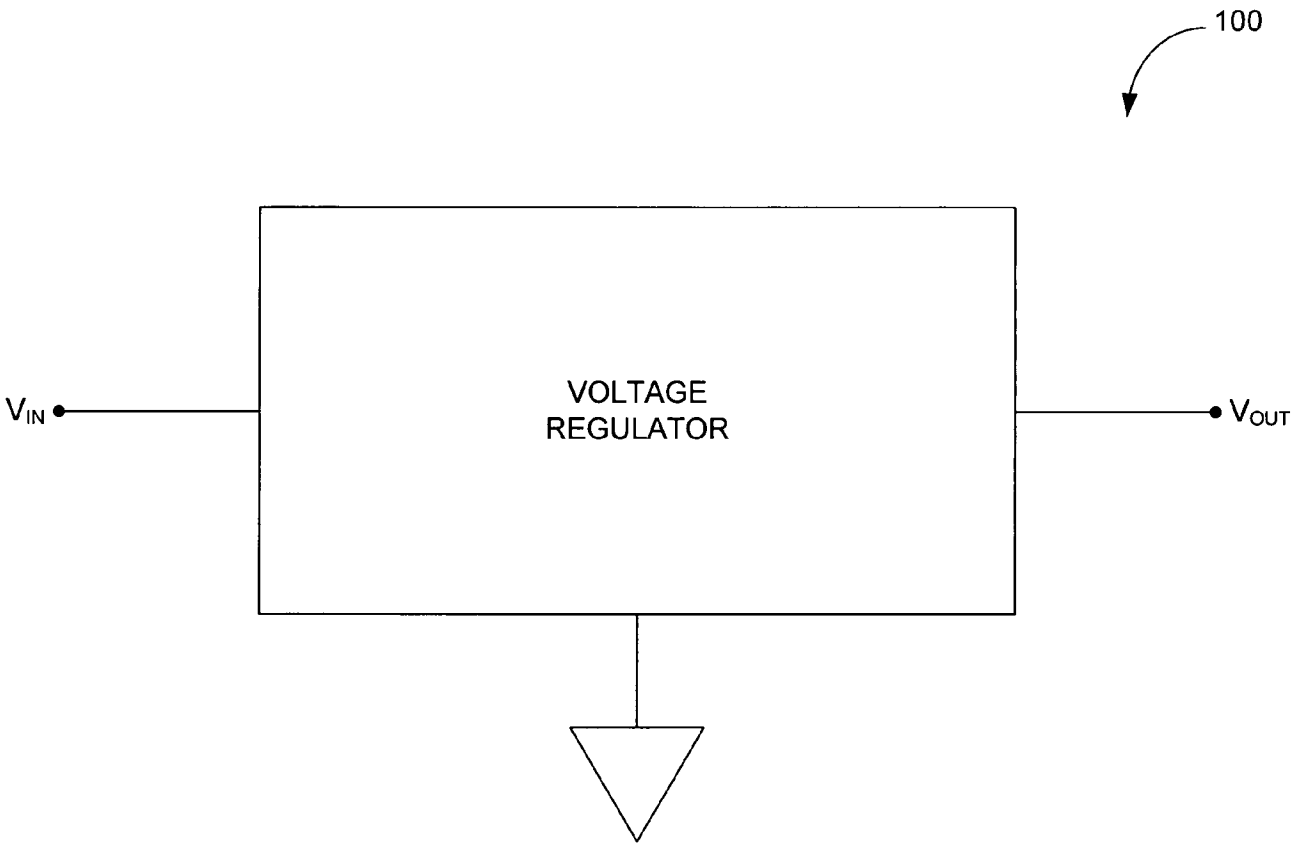
FIG. 1 is a block diagram showing a voltage regulator and its input and output.

The present invention will now be described with reference to the accompanying drawings. In the drawings, like reference numbers may indicate identical or functionally similar elements. Additionally, the left-most digit(s) of a reference number may identify the drawing in which the reference number first appears.

DETAILED DESCRIPTION OF THE INVENTION

While specific configurations and arrangements are discussed, it should be understood that this is done for illustrative purposes only. A person skilled in the pertinent art(s) will recognize that other configurations and arrangements can be used without departing from the spirit and scope of the present invention. It will be apparent to a person skilled in the pertinent art(s) that this invention can also be employed in a variety of applications.

A voltage supply such as a battery used in a computer or mobile telephone does not always supply a constant voltage to the device. A mobile telephone battery can vary from 4V to 4.5V, for example, due to fluctuations, ripples, noise, or general variability. In order to provide a constant and consistent voltage supply from a voltage supply source, a voltage regulator is used, such as that depicted in FIG. 1. Voltage regulator 100 receives a voltage input signal $V_{IN}$ (from a battery, for example) and outputs an output voltage signal $V_{OUT}$. Ideally, a constant output voltage signal $V_{OUT}$ is desired. However, if voltage input signal $V_{IN}$ drops below a certain level, a consistent output voltage signal $V_{OUT}$ might not be provided. In other words, for a voltage input signal $V_{IN}$ at or above a certain level, a constant and consistent output voltage signal $V_{OUT}$ is desired.

Figure 2:
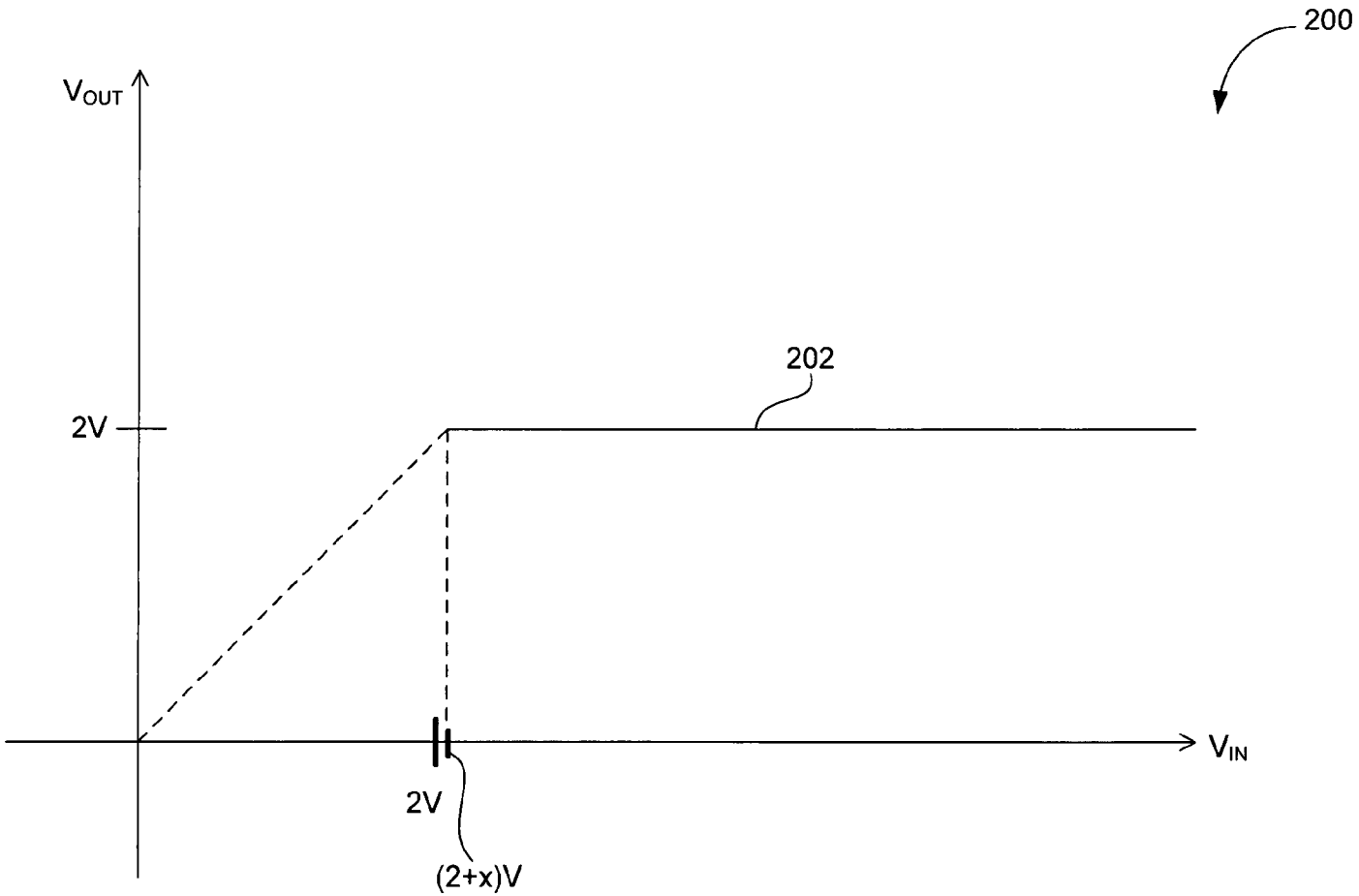
FIG. 2 is a graph showing output voltage signal $V_{OUT}$ versus voltage input signal $V_{IN}$, according to an embodiment of the present invention.

One disadvantage of a conventional voltage regulator is that it requires a voltage input signal $V_{IN}$ that is significantly higher than the desired output voltage signal $V_{OUT}$ (e.g., twice $V_{OUT}$). For example, for a conventional 1.5V voltage regulator, the voltage input signal $V_{IN}$ needs to be at least 3V. However, in some applications, the voltage input signal $V_{IN}$ can drop to a level very close to the desired output voltage signal $V_{OUT}$ (e.g., as low as 1.7V for a 1.5V voltage regulator), causing an unregulated output voltage signal $V_{OUT}$. A low-drop-out voltage regulator (LDO) maintains a stable output voltage signal $V_{OUT}$ even if the voltage input signal $V_{IN}$ drops to a level very close to the desired output voltage signal $V_{OUT}$. For example, if a 2V output voltage signal $V_{OUT}$ is desired, voltage input signal $V_{IN}$ can be as low as 2V plus a very small voltage (e.g., 0.2V), as graphically depicted in FIG. 2 as plot 202 in graph 200.

Figure 3:
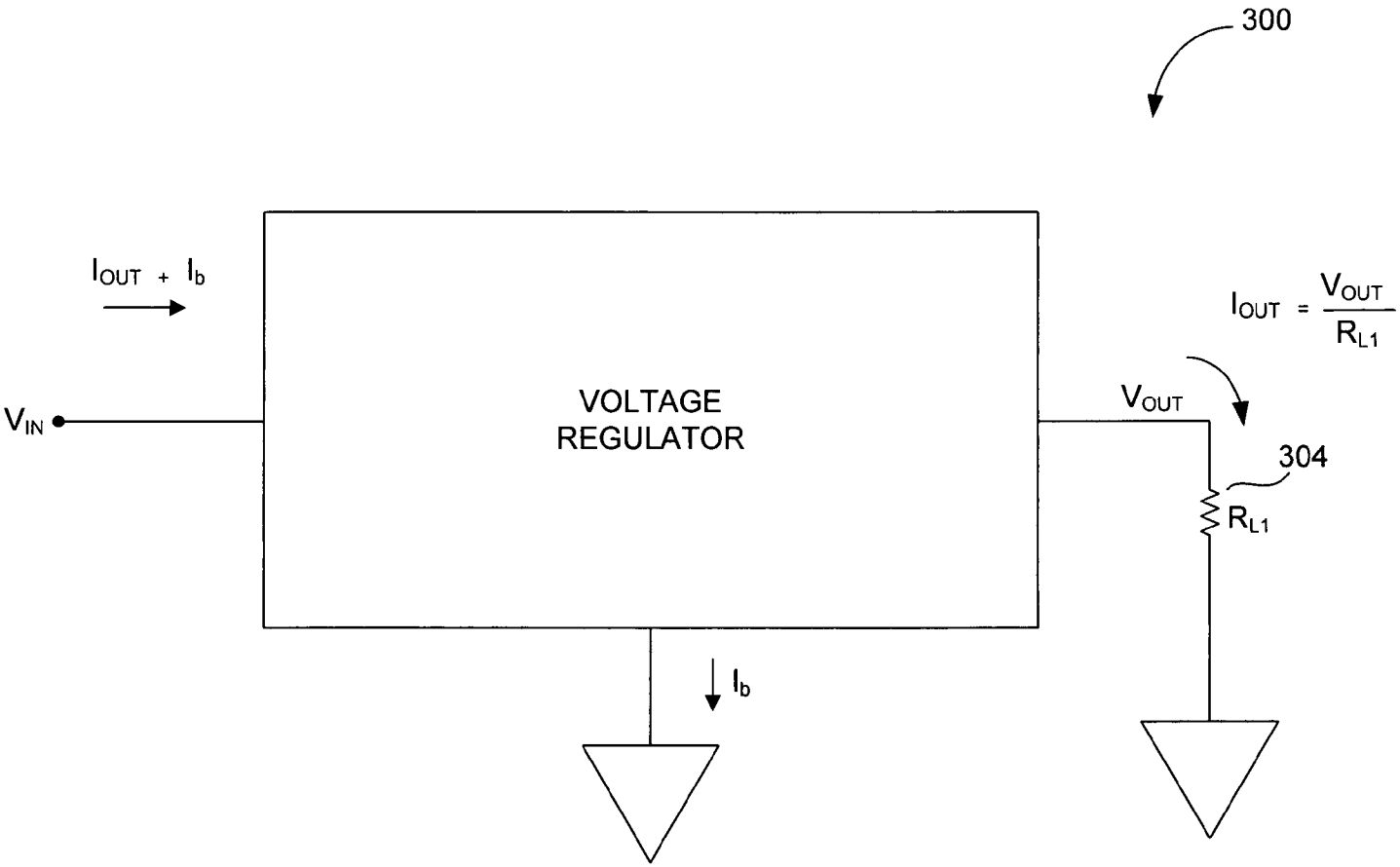
FIG. 3 is a block diagram showing a voltage regulator and its input and output, including a resistive load.

Another object of the present invention is to minimize power and current consumption in the voltage regulator. FIG. 3 depicts a voltage regulator 300 that has a resistive load $R_{L1}$ that draws a current $I_{OUT}=V_{OUT}/R_{L1}$. Ideally, it is desirable to draw the same current at the voltage regulator input as the output. However, in order to regulate output voltage signal $V_{OUT}$, extra current $I_b$ is needed. One goal of the present invention is to minimize this extra current $I_b$ for low power consumption. In one embodiment of the present invention, it is desirable to keep this extra current $I_b$ on the order of a few micro-amps to about 30 micro-amps, depending on the amount of current at the output.

The following description describes a low-drop-out voltage regulator (LDO) in which the output voltage signal $V_{OUT}$ and the associated current can be regulated or programmed.

Figure 4:
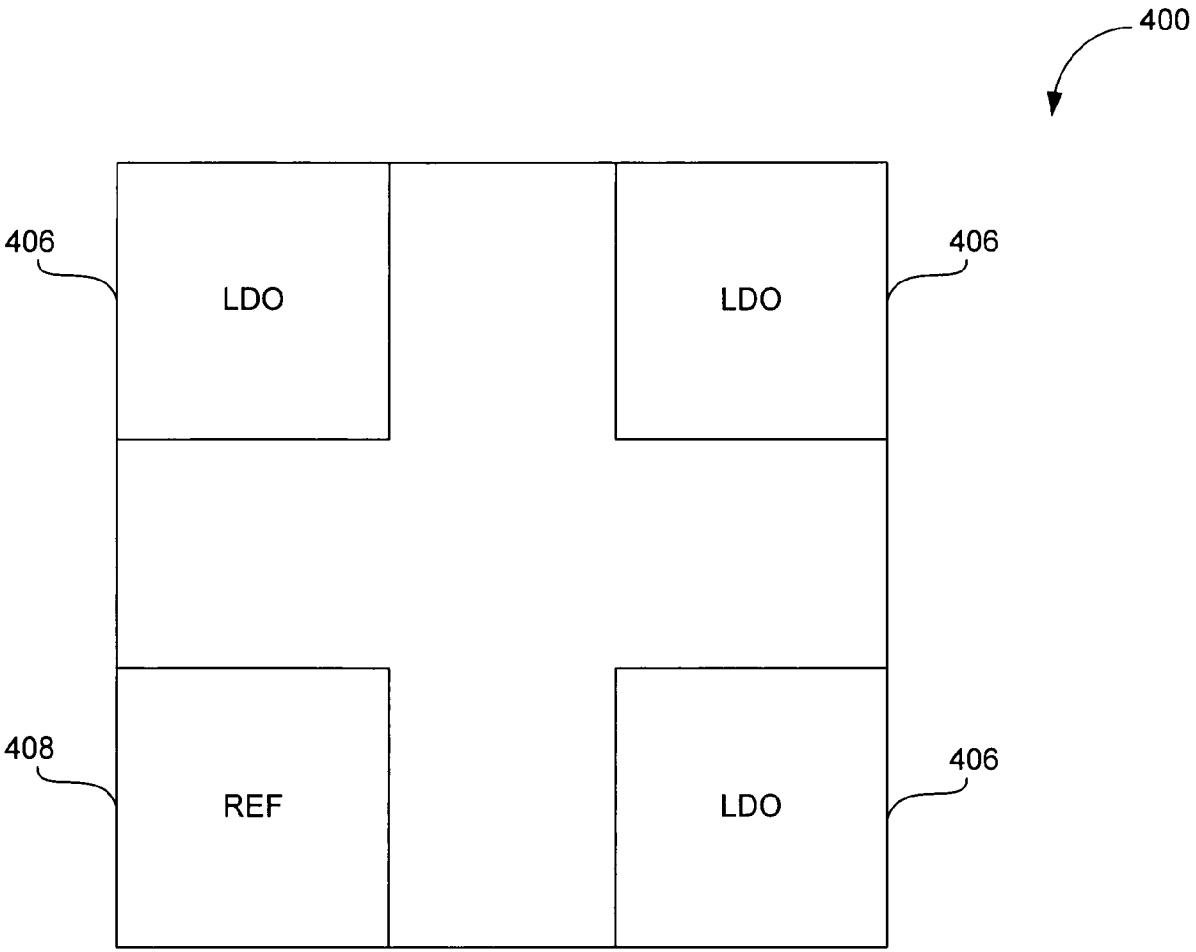
FIG. 4 depicts a single substrate including multiple low-drop-out voltage regulators and a reference voltage source, according to an embodiment of the present invention.

Depending on the application, one or more LDOs can be used. For example, FIG. 4 depicts a single substrate (i.e., chip) 400 that includes three LDOs 406 and an accurate reference voltage source 408, according to an embodiment of the present invention. The accurate reference voltage source can be on the same chip as the one or more LDOs (as shown in FIG. 4) or can be external to the chip (i.e., off-chip) (not shown). Accurate reference voltage source 408 can be large and can also consume a large amount of power. However, it can be used just during calibration, so it does not need to be constantly on. An accurate reference voltage signal REF from the accurate reference voltage source 408 is compared to the output voltage signal $V_{OUT}$ of an LDO, as shown in FIG. 5, for example.

Figure 5:
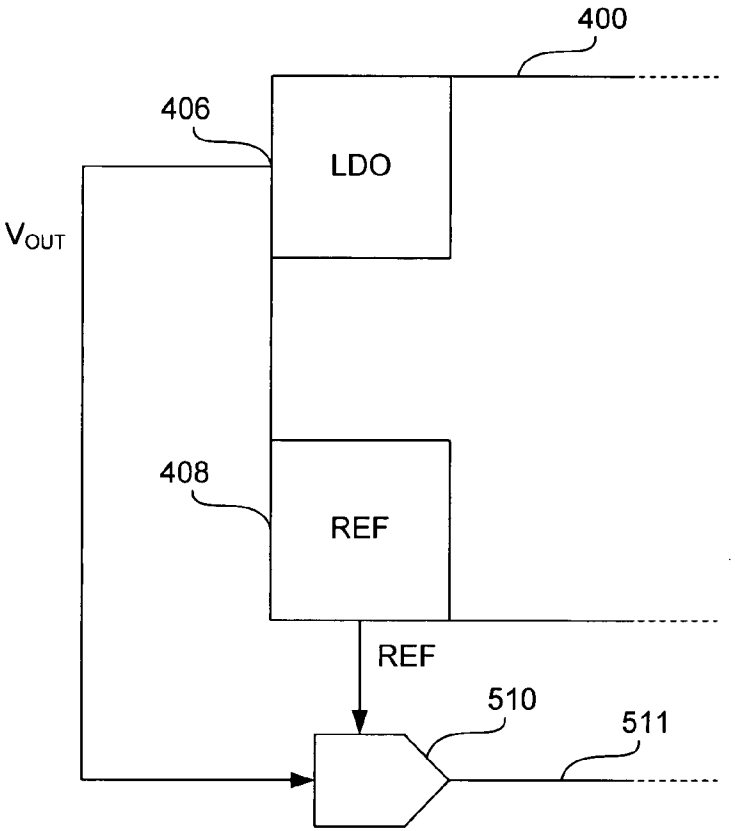
FIG. 5 depicts a substrate such as that shown in FIG. 4, along with a comparison device, according to an embodiment of the present invention.
Figure 6:
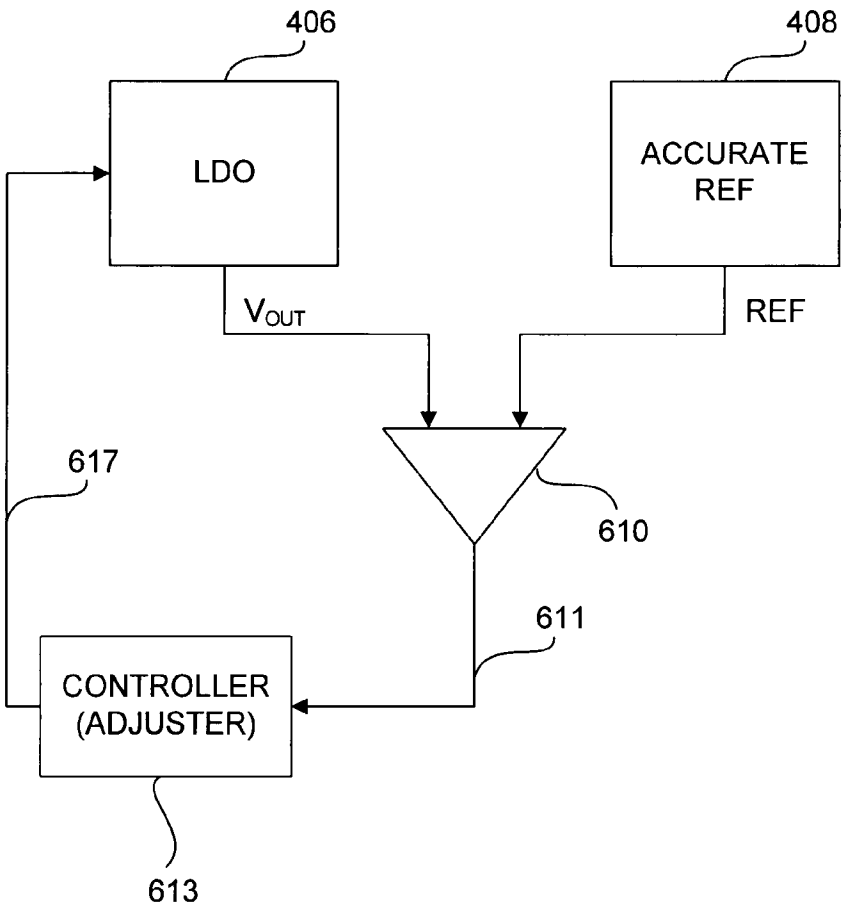
FIG. 6 depicts an example of the embodiment shown in FIG. 5 using a comparator, according to an embodiment of the present invention.
Figure 7:
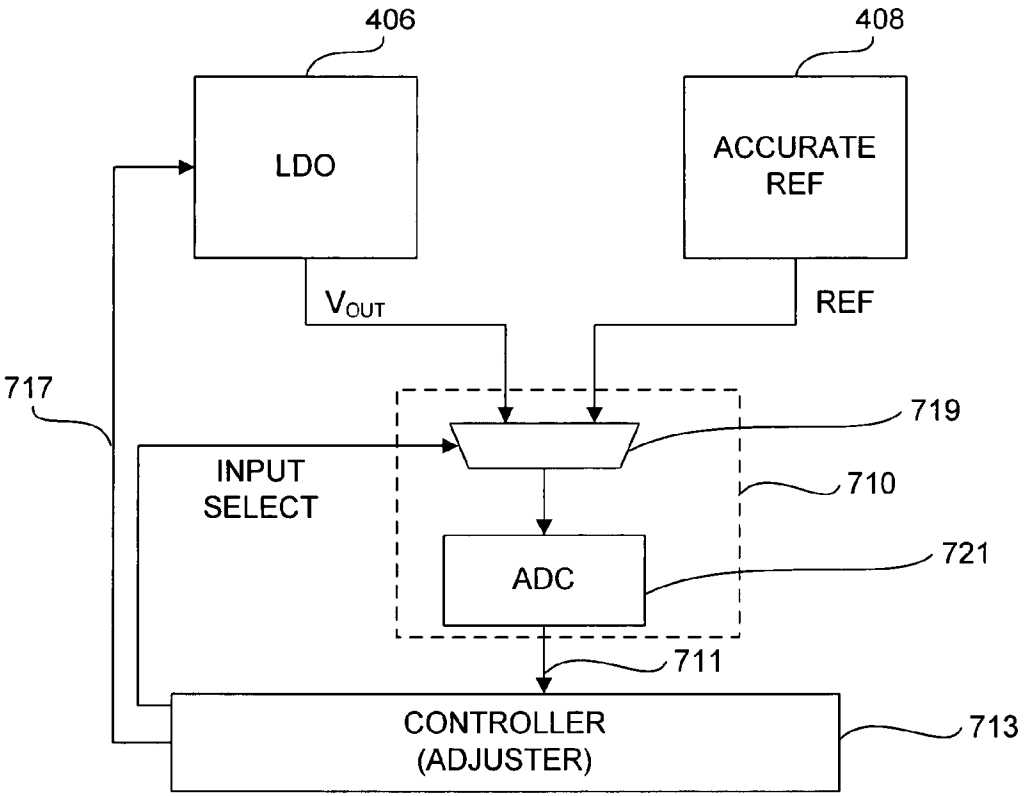
FIG. 7 depicts an example of the embodiment shown in FIG. 5 using an analog-to-digital converter, according to an embodiment of the present invention.

FIG. 5 shows an LDO 406 and accurate reference voltage source 408 of chip 400 and also shows a comparison device 510, according to an embodiment of the present invention. Comparison device 510 receives output voltage signal $V_{OUT}$ of LDO 406 and accurate reference voltage signal REF from accurate reference voltage source 408 and compares them. Comparison device 510 can be, for example, a low-offset comparator, as shown in FIG. 6, or an analog-to-digital converter, as shown in FIG. 7. Comparison device 510 outputs an adjustment signal 511 that signifies tuning necessary to adjust output voltage signal $V_{OUT}$ in the direction of the value of accurate reference voltage signal REF. If output voltage signal $V_{OUT}$ and accurate reference voltage signal REF are the same value, then no adjustment is necessary. If output voltage signal $V_{OUT}$ and accurate reference voltage signal REF are not the same value, then an additional circuit can be used to tune the LDO. For example, a feedback loop or a successive approximation technique can be used to adjust the output voltage signal $V_{OUT}$ until it reaches a desired level. The adjustment can be accomplished in the digital domain. Example embodiments are shown in FIGS. 6 and 7.

FIG. 6 is an example of a comparison and feedback loop for LDO 406, according to an embodiment of the invention. Output voltage signal $V_{OUT}$ of LDO 406 and accurate reference voltage signal REF from accurate reference voltage source 408 are input to a comparator 610. Comparison result signal 611 is output from comparator 610 and input into a controller 613. An adjustment signal 617 is output from controller 613 and input to LDO 406 in order to adjust output voltage signal $V_{OUT}$.

FIG. 7 is another example of a comparison and feedback loop for LDO 406, according to an embodiment of the invention. Comparison device 510 of FIG. 5 is represented by box 710. Comparison device 710 includes a multiplexer 719 and an analog-to-digital converter 721. Output voltage signal $V_{OUT}$ of LDO 406 and accurate reference voltage signal REF from accurate reference voltage source 408 are input to multiplexer 719. The output of multiplexer 719 is input to analog-to-digital converter 721. Signal 711 is output from analog-to-digital converter 721 and input to a controller 713. An adjustment signal 717 is output from controller 713 and input to LDO 406 in order to adjust output voltage signal $V_{OUT}$. An input select signal (INPUT SELECT) is also output from analog-to-digital converter 721 and input to multiplexer 719.

Figure 8:
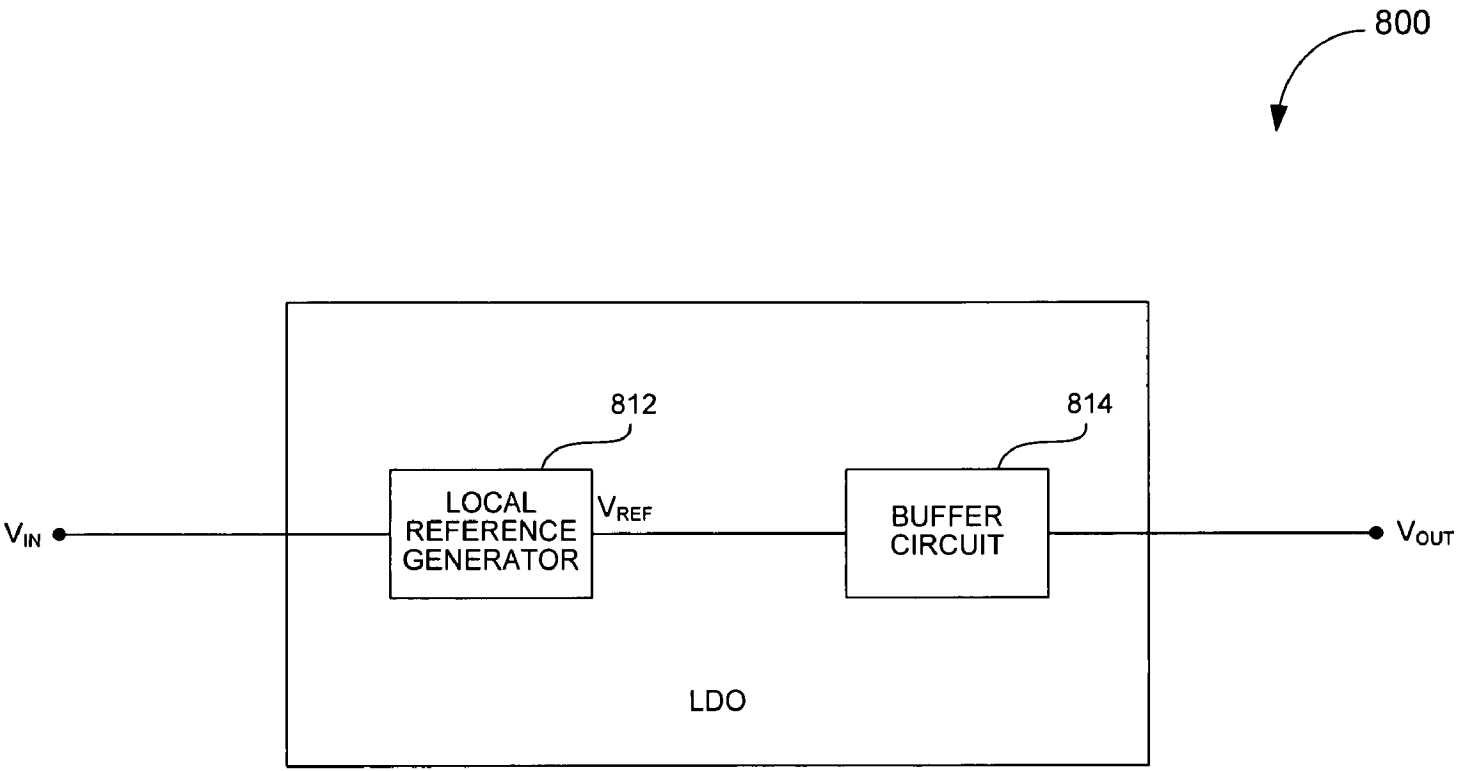
FIG. 8 depicts a low-drop-out voltage regulator with a local reference generator, according to an embodiment of the present invention.

FIG. 8 depicts components of an LDO 800. LDO 800 includes a local reference generator 812 and a buffer circuit 814. Local reference generator 812 is a bandgap circuit that receives voltage input signal $V_{IN}$ (from a battery, for example) and outputs reference voltage signal $V_{REF}$. Bandgap circuits and their operation are well known to those skilled in the relevant art(s). Buffer circuit 814 receives reference voltage signal $V_{REF}$ and outputs a regulated output voltage signal $V_{OUT}$. The accuracy of an LDO such as LDO 800 is determined by both local reference generator 812 and buffer circuit 814. However, its accuracy is dominated by local reference generator 812. For good accuracy, local reference generator 812 would need to be large and/or consume higher power, which contradict objects of the present invention, including a small die area and low power consumption. For this reason, it is advantageous to use an accurate reference voltage source for calibration purposes such as accurate reference voltage source 408 as described above with reference to FIGS. 4-7. Conducting calibration using an accurate reference voltage source allows the LDO(s) to be less accurate themselves, which means that they can be smaller (i.e., use less die area) and have a lower current (i.e., less power consumption). This becomes important when using more than one LDO on a single chip.

Figure 9:
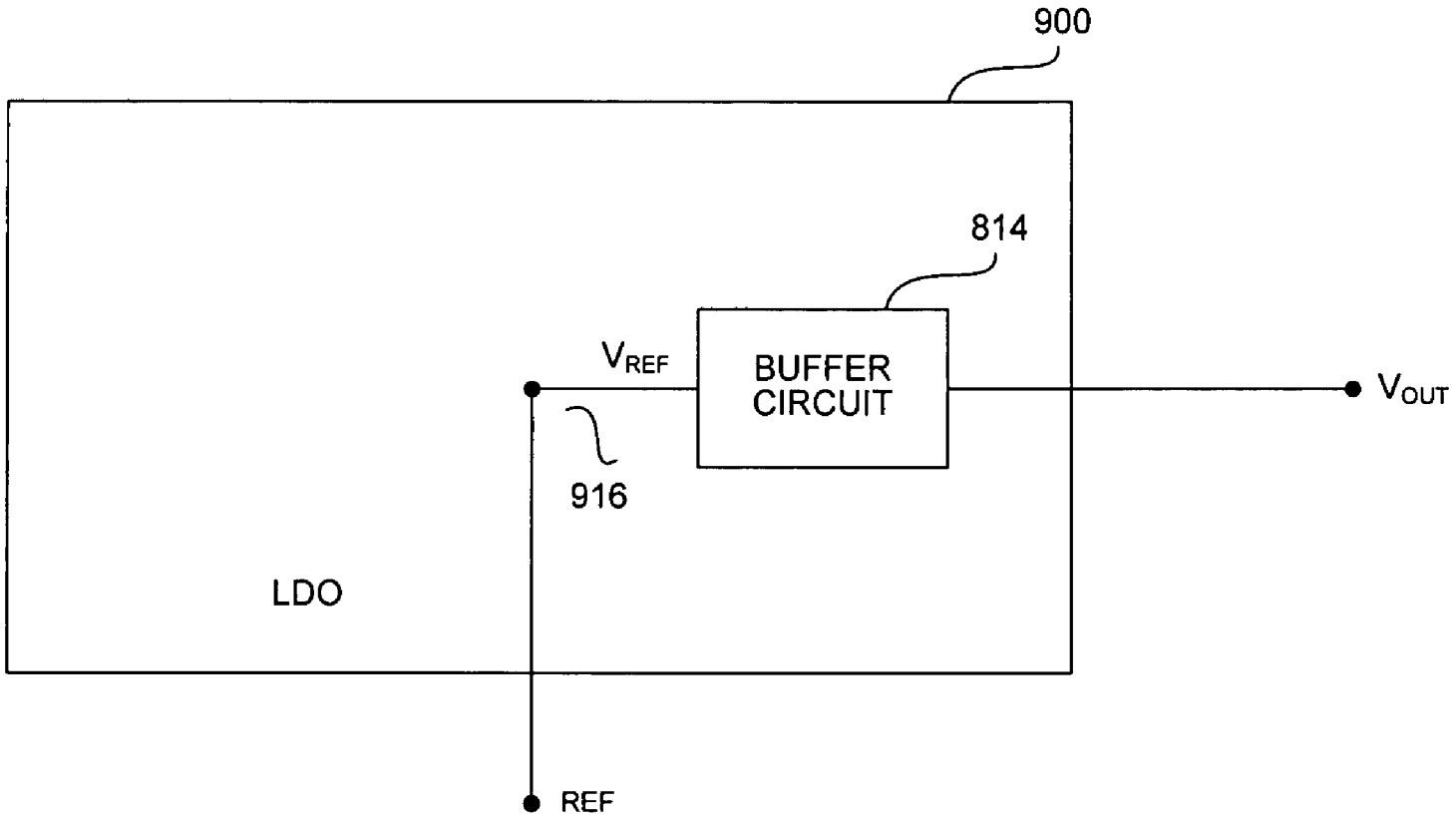
FIG. 9 depicts a low-drop-out voltage regulator with an optional external reference generator, according to an embodiment of the present invention.

In one embodiment of the present invention, accurate reference voltage signal REF from an accurate reference voltage source 408 can be used as the reference voltage signal $V_{REF}$ that is input to buffer circuit 814, instead of a reference voltage signal $V_{REF}$ that is derived from local reference generator 812, as depicted in FIG. 9. FIG. 9 shows accurate reference voltage signal REF being input to LDO 900 at node 916. In this embodiment, the inaccuracies introduced by local reference generator 812 are alleviated, but inaccuracies introduced by buffer circuit 814 remain. Calibration as described above with reference to FIGS. 4-7 calibrates the entire LDO, and therefore inaccuracies introduced by both the local reference generator and the buffer circuit are alleviated. Even if accurate reference voltage signal REF is used as shown in FIG. 9, it is still important that each LDO have its own dedicated, although ordinary, local reference generator to allow each LDO to be small with low current/power consumption and to provide immunity to noise and cross talks on the reference voltage.

Figure 10:
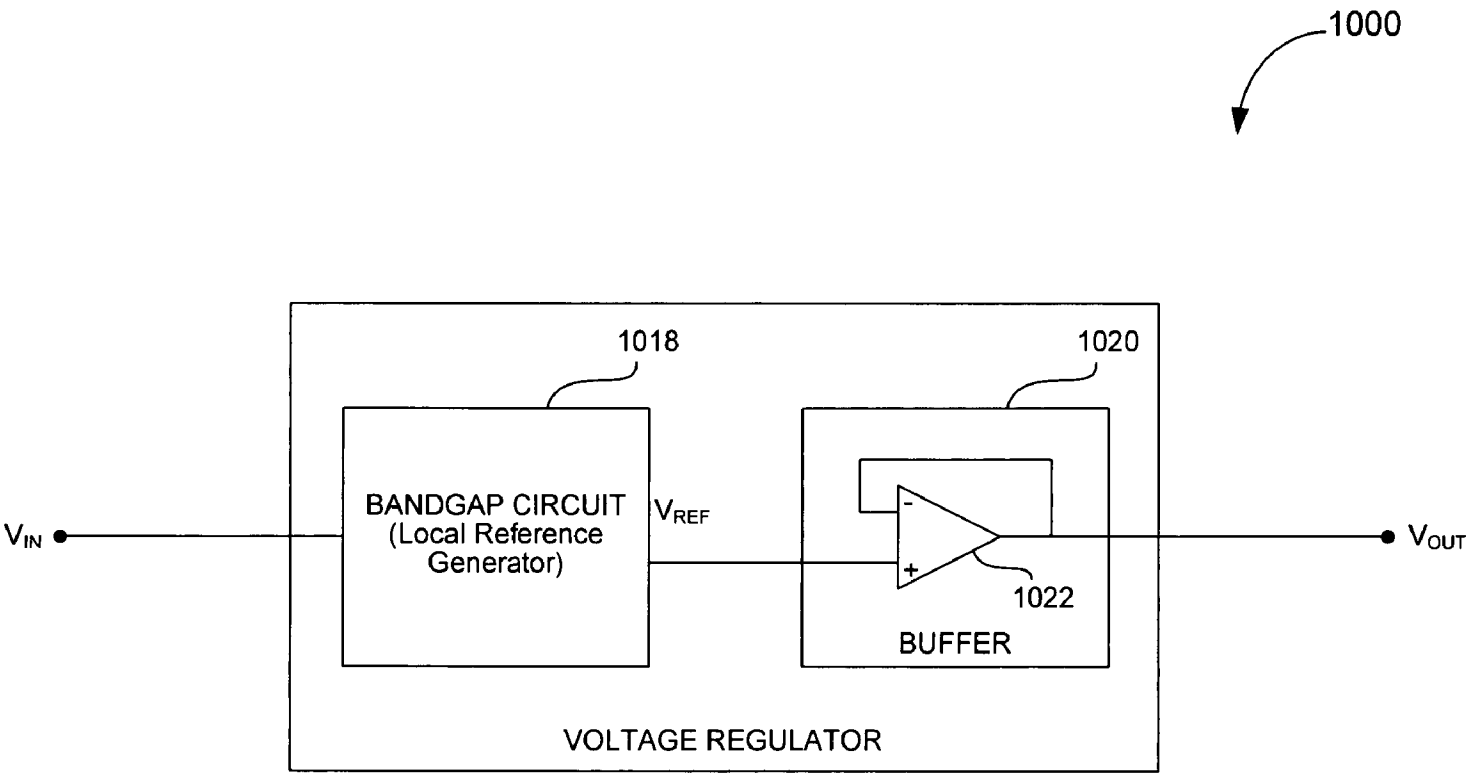
FIG. 10 depicts a voltage regulator with a bandgap circuit (local reference generator) and a buffer similar to an operational amplifier.

A conventional voltage regulator, such as voltage regulator 1000 shown in FIG. 10, includes a bandgap circuit 1018 and a buffer circuit 1020 including an operational amplifier 1022 or similar circuit. Bandgap circuit 1018 is a local reference generator and will provide a fixed voltage to operational amplifier 1022. Operational amplifier 1022 is a buffer, such that the output voltage (output voltage signal $V_{OUT}$) of operational amplifier 1022 is ideally the same as the fixed voltage provided to it. Voltage regulation occurs in operational amplifier 1022. If the reference voltage signal $V_{REF}$ input to the operational amplifier 1022 is 1.2V, for example, then the output voltage of operational amplifier 1022 should be about 1.2V.

As stated previously, in order to use one or more LDO(s) that have low current/power consumption and take up a smaller die area, accuracy will be somewhat sacrificed. This is why it is advantageous to compare output voltage signal $V_{OUT}$ with an accurate reference voltage signal REF from an accurate reference voltage source and trim (or tune) the output voltage signal $V_{OUT}$ accordingly. The concept of trimming the output voltage signal $V_{OUT}$ is the same as programming the output voltage signal $V_{OUT}$ to any desired voltage level. The embodiments of the present invention regarding trimming or programming the output voltage signal $V_{OUT}$ will now be discussed.

With a 1.5V LDO, one might have a voltage input signal $V_{IN}$ with a 1.7V to 2.6V range that allows an output voltage signal $V_{OUT}$ to be at about the desired 1.5V. Typically, one only regulates a voltage when $V_{IN}$ is between certain voltages. In this example, as the supply voltage drops below 1.7V, the amplifier circuitry in the LDO's operational amplifier becomes more of a resistor than an amplifier, and the gain obtained by the amplifier drops. Once the supply voltage drops to 1.5V or lower, a 1.5V output voltage signal cannot be provided. In other words, in this example, one is not concerned with the output voltage signal $V_{OUT}$ that results when $V_{IN}$ is below 1.7V or above 2.6V. One is only concerned with regulating a voltage when $V_{IN}$ is between 1.7V and 2.6V.

It should be realized, however, that due to process variations, or due to inaccuracies introduced by the LDO components, for example, the output voltage signal $V_{OUT}$ might be equal to 1.57V, or perhaps 1.48V, instead of the desired 1.5V. Or, as another example, perhaps instead of the 1.5V, one would like to program the LDO to provide other values for output voltage signal $V_{OUT}$ (e.g., 1.4V, 1.3V, 1.2V, etc.) The output voltage signal $V_{OUT}$ can be trimmed (or tuned) to an accurate value by adjusting resistances in the buffer circuit and/or after the local reference generator. This concept will be described in more detail with reference to FIGS. 11 and 12.

Figure 11:
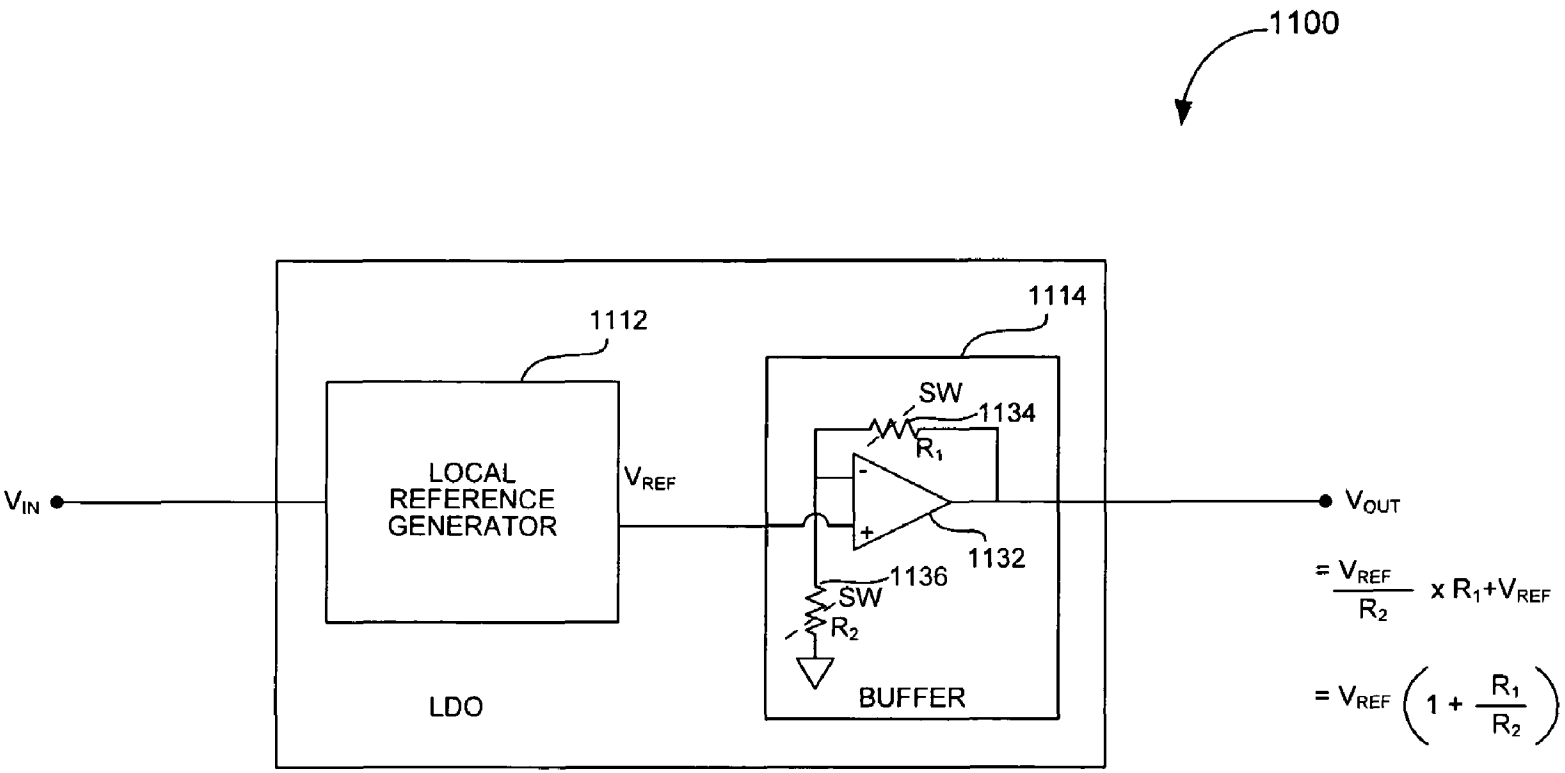
FIG. 11 depicts a low-drop-out voltage regulator with an adjustable buffer circuit, according to an embodiment of the present invention.

FIG. 11 depicts an LDO 1100 having a local reference generator 1112 that receives a voltage input signal $V_{IN}$ and outputs a reference voltage signal $V_{REF}$. LDO 1100 also has a buffer circuit 1114 that receives reference voltage signal $V_{REF}$ and outputs an output voltage signal $V_{OUT}$. Buffer circuit 1114 can be used as buffer circuit 614 in FIGS. 8 and 9, for example. Buffer circuit 1114 includes an operational amplifier 1132 that receives reference voltage signal $V_{REF}$ at its positive input terminal. Buffer circuit 1114 also includes a resistor 1134 ($R_1$) that has a first end coupled to a negative input terminal of operational amplifier 1132 and a second end coupled to the output of operational amplifier 1132, and a resistor 1136 ($R_2$) that has a first end coupled to the negative input terminal of operational amplifier 1132 and a second end coupled to ground. With this configuration, output voltage signal $V_{OUT} \approx ((V_{REF}/R_2)*R_1)+V_{REF} \approx V_{REF}(1+R_1/R_2)$. The addition of resistors $R_1$ and $R_2$ will cause output voltage signal $V_{OUT}$ to be higher than reference voltage signal $V_{REF}$. In other words, the addition of resistors $R_1$ and $R_2$ will allow an increase in output voltage signal $V_{OUT}$. By choosing a certain ratio between resistors $R_1$ and $R_2$, one can adjust or program output voltage signal $V_{OUT}$. In other embodiments, two or more resistors 1134 and/or two or more resistors 1136 can be used. In these embodiments, any of resistor(s) 1134 and resistor(s) 1136 can be switched in or out, using corresponding switches, for example, to adjust or program output voltage signal $V_{OUT}$.

Figure 12:
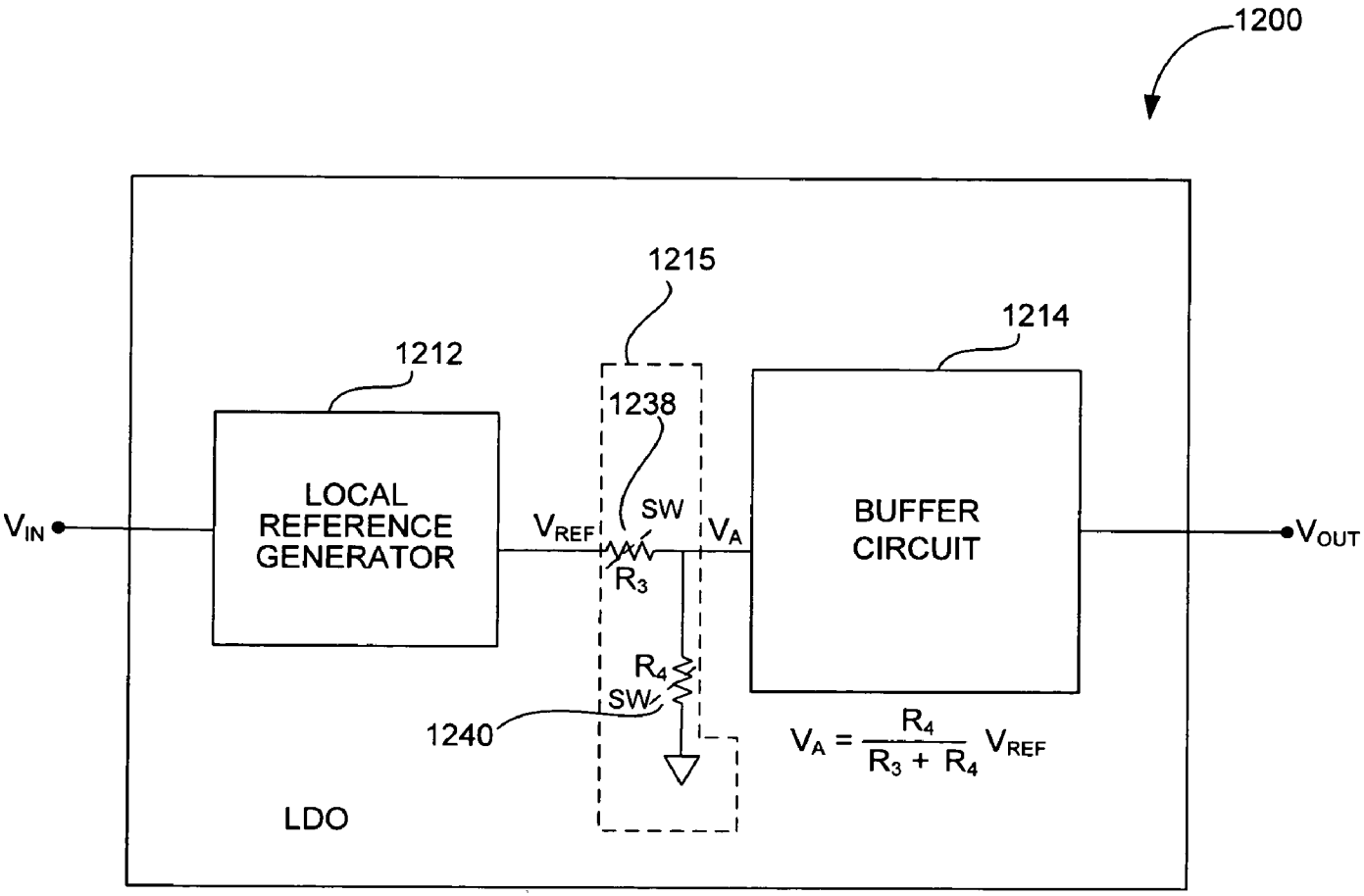
FIG. 12 depicts a low-drop-out voltage regulator with an adjustable attenuator, according to an embodiment of the present invention.

FIG. 12 depicts an LDO 1200 having a local reference generator 1212 that receives a voltage input signal $V_{IN}$ and outputs a reference voltage signal $V_{REF}$. LDO 1200 also has an attenuator circuit 1215 that receives reference voltage signal $V_{REF}$ and outputs an attenuated reference voltage signal $V_A$. LDO 1200 additionally has a buffer circuit 1214 that receives attenuated reference voltage signal $V_A$ from attenuator circuit 1215 and outputs an output voltage signal $V_{OUT}$. Attenuator circuit 1215 can be used prior to buffer circuit 814 of FIG. 8 or buffer circuit 1114 of FIG. 11, for example, and can provide attenuated reference voltage signal $V_A$ to buffer circuits 814/1114 instead of $V_{REF}$. Attenuator circuit 1215 includes a resistor 1238 ($R_3$) that has a first end coupled to a local reference generator 1212 and a second end coupled to buffer circuit 1214, and a resistor 1240 ($R_4$) that has a first end coupled to the second end of $R_3$ and a second end coupled to ground. With this configuration, attenuated reference voltage signal $V_A \approx V_{REF}*(R_4/(R_3+R_4))$. The addition of resistors $R_3$ and $R_4$ result in attenuated reference voltage signal $V_A$ being lower than reference voltage signal $V_{REF}$, which will then result in output voltage signal $V_{OUT}$ being lower than reference voltage signal $V_{REF}$. In other words, the addition of resistors $R_3$ and $R_4$ will allow a decrease in output voltage signal $V_{OUT}$. In other embodiments, two or more resistors 1238 and/or two or more resistors 1240 can be used. In these embodiments, any of resistor(s) 1238 and resistor(s) 1240 can be switched in or out, using corresponding switches, for example, to adjust or program output voltage signal $V_{OUT}$.

Figure 16:
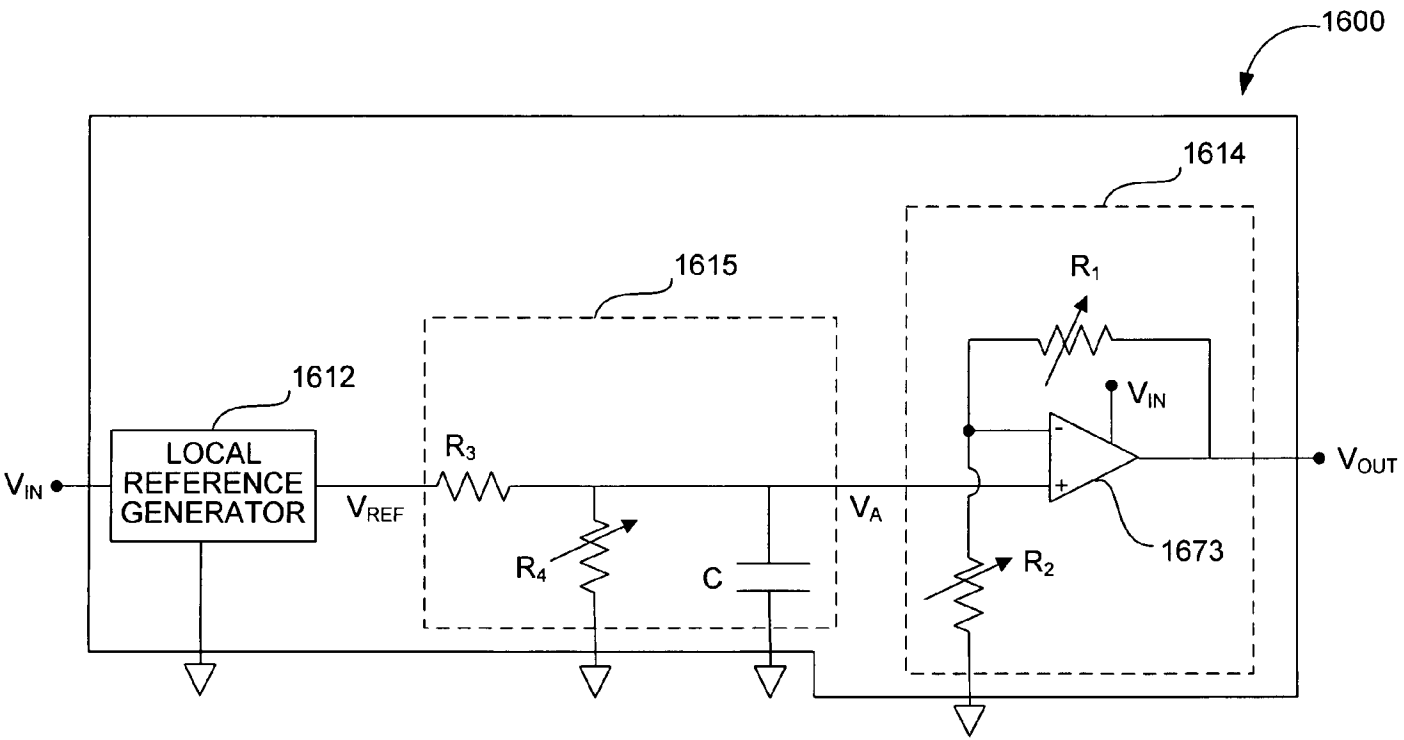
FIG. 16 is a diagram of an exemplary low-drop-out voltage regulator, according to an embodiment of the present invention.

FIG. 16 shows a more detailed embodiment of the present invention in LDO 1600, including local reference generator 1612, attenuator circuit 1615, and buffer circuit 1614, which includes operational amplifier 1673. Similar to attenuator circuit 1215 in FIG. 12, attenuator circuit 1615 has one resistor $R_3$ and a plurality of resistors $R_4$, which can be of differing resistances. Compared to buffer circuit 1114 of FIG. 11, buffer circuit 1614 has a plurality of resistors $R_1$ and a plurality of resistors $R_2$. The resistors of attenuator circuit 1615 and buffer circuit 1614 can be resistor/switch pairs. The more resistor/switch pairs used, the more flexible the adjustment capabilities.

As stated previously, it is preferable to have low power consumption in the LDO(s). In a conventional voltage regulator, the operational amplifier can provide a large amount of output current. In addition, the output current can have a very wide range. It can be upwards of hundreds of milli-amps or can be as low as a few micro-amps. It is therefore advantageous to have the LDO(s) capable of having the output current programmable to keep power consumption low as needed (e.g., when in standby or sleep mode). For example, an LDO can have the capability of programming current into different mode levels (e.g., low current mode, medium current mode, and/or high current mode). When the current changes, however, the output voltage also changes. In this situation, it is an added advantage to have output voltage programming capabilities as described above. By having the capability of programming the output current, the output voltage variation versus the output current improves because the output voltage variation is tighter. In other words, by having the capability of programming the output current, the stability of the LDO improves. When one wishes to stabilize an LDO, the stabilization might depend on the current output current. If the output current has dropped too low, for example, there may be a stability issue, but if the output current is programmable, then the LDO can be switched to a lower current mode to improve stability. Embodiments of the present invention that involve the programming of output current will now be described, after an introduction to the components of an LDO's operational amplifier.

Figure 13:
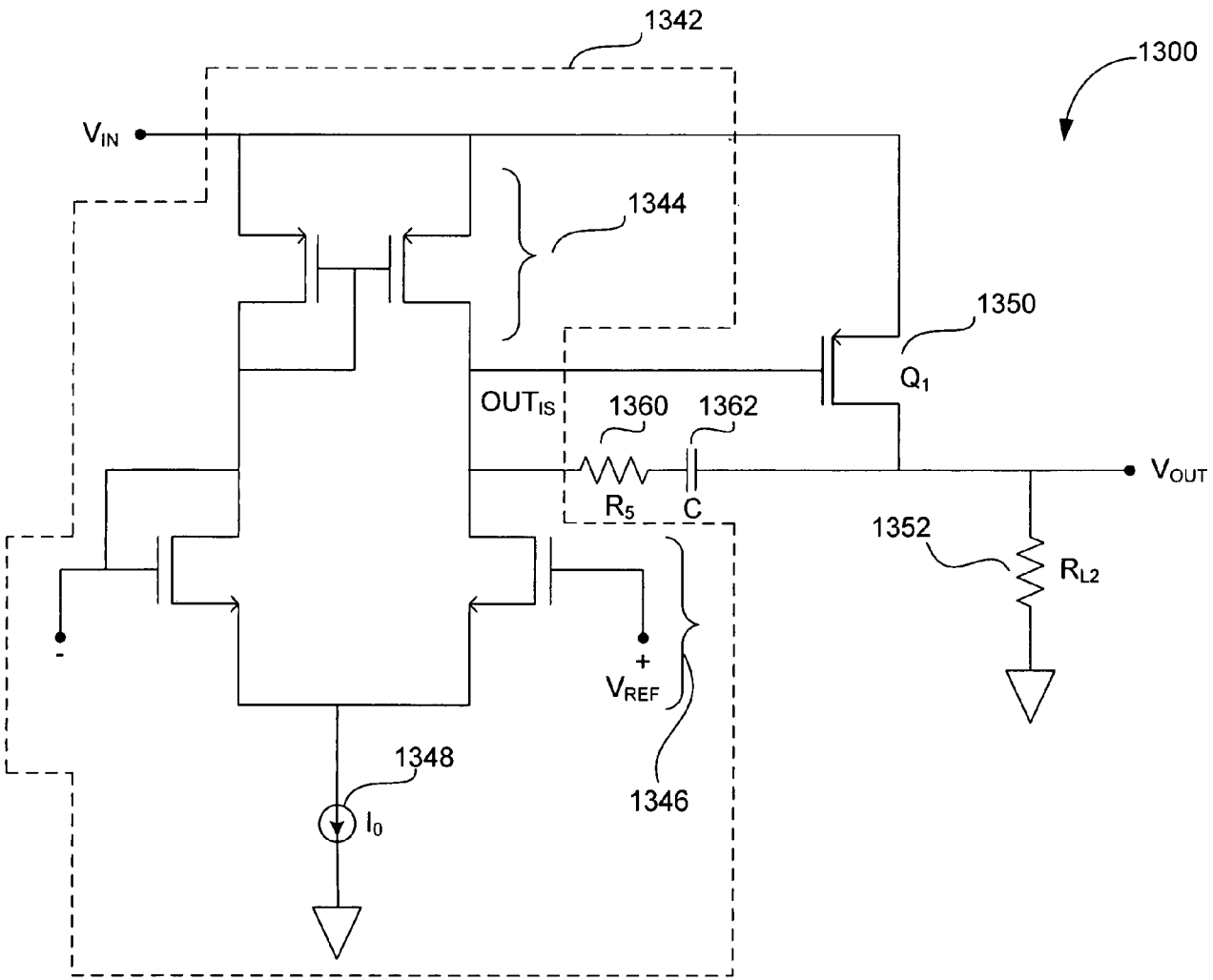
FIG. 13 is a schematic diagram of an operational amplifier, according to an embodiment of the present invention.

FIG. 13 is a schematic diagram of an operational amplifier 1300 as can be used in an LDO as described herein. For example, operational amplifier 1300 can be used in buffer circuit 1214. The operational amplifier 1300 includes an input stage 1342, an amplifier device 1350 ($Q_1$) (a transistor, for example), and a resistive load 1352 ($R_{L2}$). Amplifier device $Q_1$ is responsible for amplification. Resistive load $R_{L2}$ can be used to draw a current. Input stage 1342 includes input terminal transistor pair 1346, voltage input transistor pair 1344, and current source 1348 ($I_0$). Reference voltage signal $V_{REF}$ is input at a gate of a positive input terminal transistor of the input terminal transistor pair 1346, and voltage input signal $V_{IN}$ is input at sources of voltage input transistor pair 1344. The voltage input signal $V_{IN}$ and an output of the input stage $OUT_{IS}$ are provided to amplifier device 1350 ($Q_1$). A combination of a resistor 1360 ($R_5$) and a capacitor 1362 (C) is placed between the input stage 1342 and the drain of amplifier transistor $Q_1$. The $R_5$/C combination provides stability in the operational amplifier circuit. The output of operational amplifier 1300, which is also the output of the LDO providing output voltage signal $V_{OUT}$, is at a drain of amplifier device $Q_1$. In another embodiment, a source follower circuit is added between the input stage 1342 and amplifier device 1350, such as source follower circuit 1454 of an operational amplifier 1400 shown in FIG. 14. Source follower circuit 1454 includes a source follower transistor 1456 and a current source 1458 ($I_1$).

Figure 14:
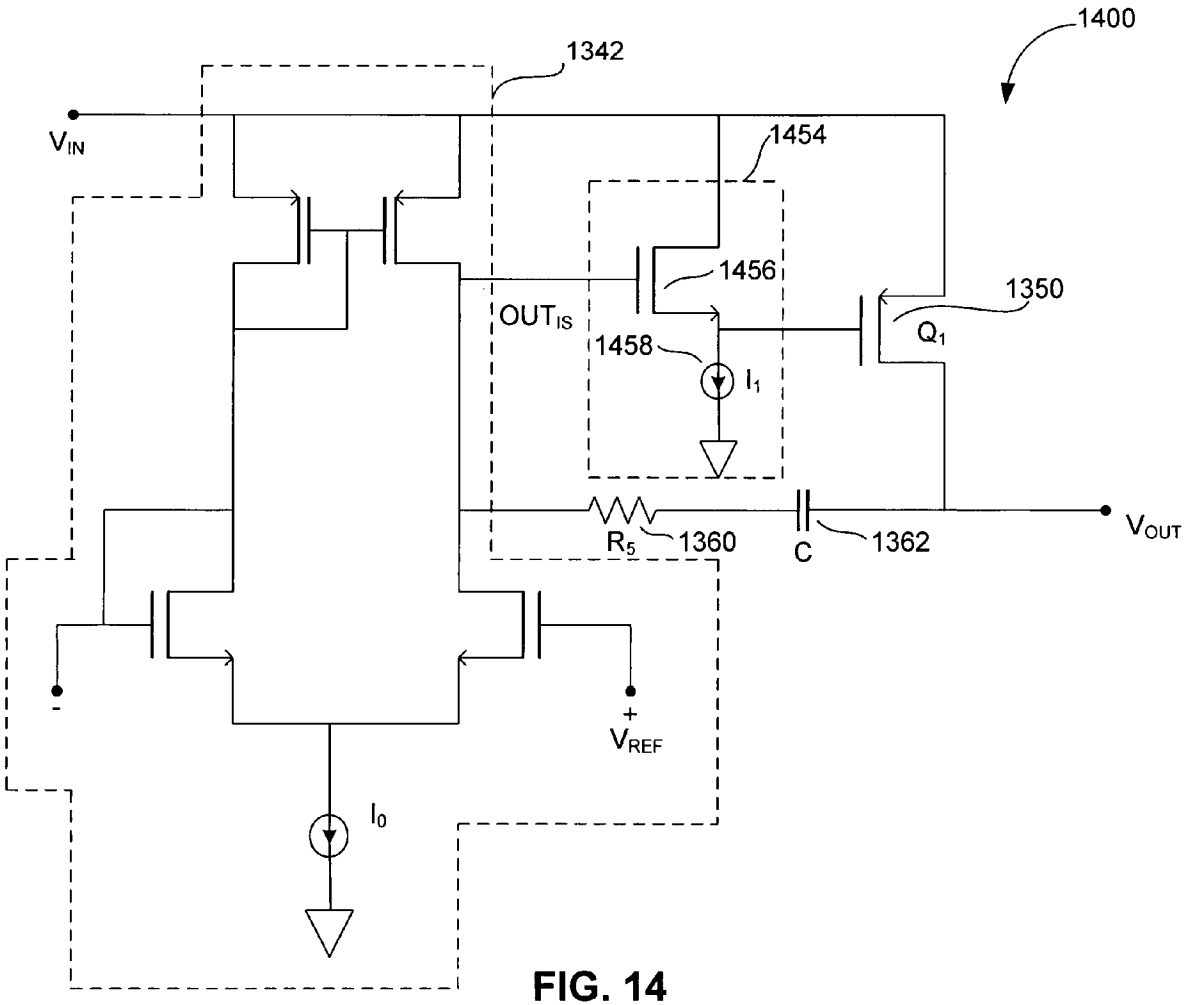
FIG. 14 is a schematic diagram of an operational amplifier with a source follower and resistor-capacitor combination, according to an embodiment of the present invention.
Figure 15:
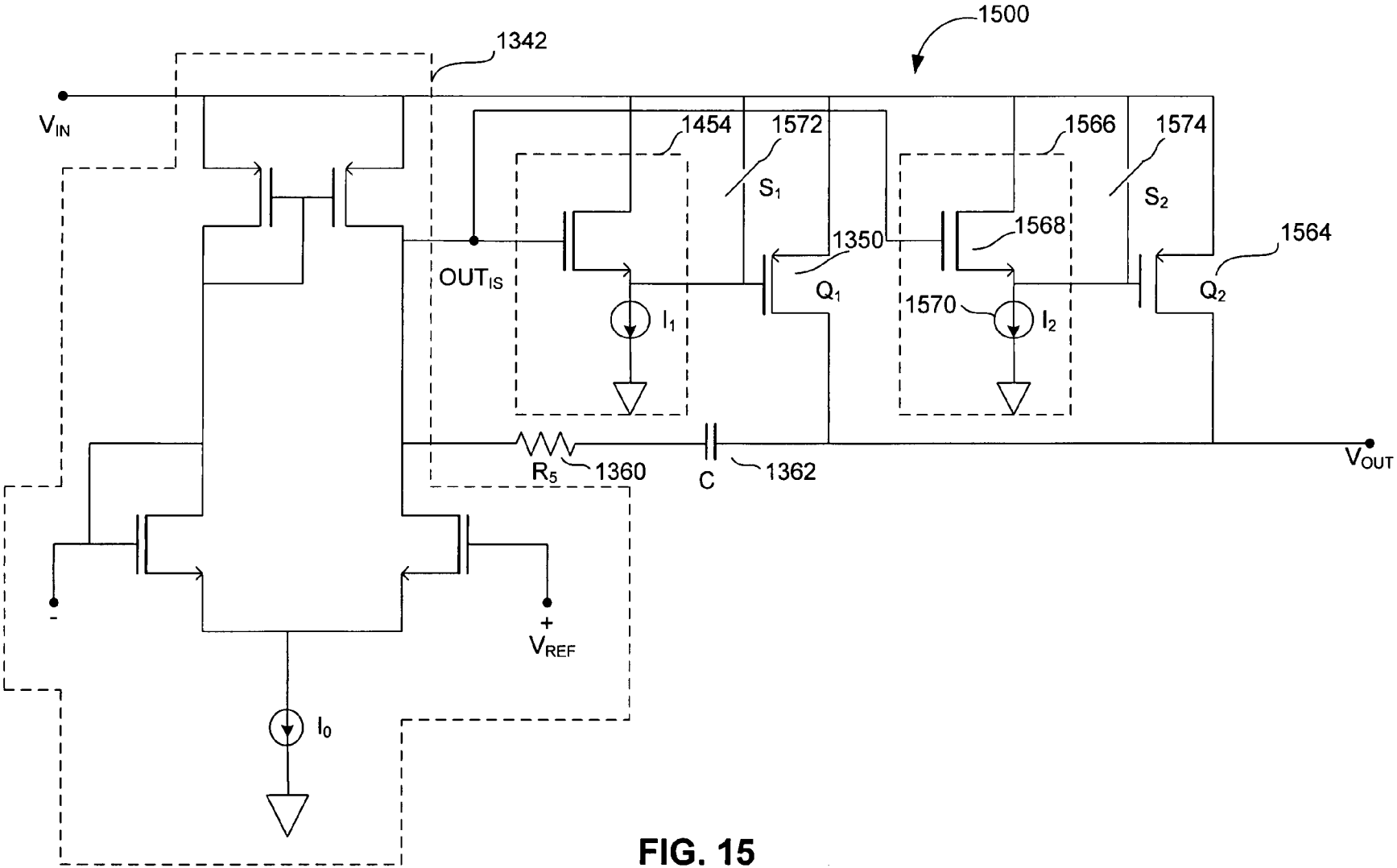
FIG. 15 is a schematic diagram of an operational amplifier with two programmable amplifier tiers, according to an embodiment of the present invention.

In order to provide capability to program the output current of an LDO, amplification tiers can be added to operational amplifier 1400 of FIG. 14, for example. This is shown in operational amplifier 1500 of FIG. 15. FIG. 15 is similar to FIG. 14, except for the addition of a second amplifier tier and switches that allow programmability. A first amplifier tier includes amplifier device 1350 ($Q_1$), source follower circuit 1454, and a switch 1572 ($S_1$) coupled between a gate of amplifier device $Q_1$ and the sources of voltage input transistor pair 1344 (labeled in FIG. 13). A second amplifier tier includes a second amplifier device 1564 ($Q_2$), a second source follower circuit 1566 (including source follower transistor 1568 and current source 1570 ($I_2$)), and a switch 1574 ($S_2$). Similar to the source follower circuit 1454 of the first amplifier tier, the second source follower circuit 1566 is coupled between the input stage and its corresponding amplifier device $Q_2$. Switch $S_2$ is coupled between a gate of amplifier device $Q_2$ and the sources of voltage input transistor pair 1344 (labeled in FIG. 13).

Amplifier devices $Q_1$ and $Q_2$ can be of differing sizes (e.g., $Q_1$ can be twenty (20) times the size of $Q_2$). Current at the operational amplifier output comes from voltage input signal $V_{IN}$ and goes through amplifier devices $Q_1$ and $Q_2$. Amplifier devices Q1 and Q2 need to be large enough to allow the LDO to regulate the output current when reference voltage signal $V_{REF}$ is low (e.g., 0.2V higher than $V_{OUT}$). When the current is high, one or more large amplifier devices are needed. Therefore, when a large amount of current is desired at the output, then both current sources $I_1$ and $I_2$ and both amplifier devices $Q_1$ and $Q_2$ can be left on. However, if the output current becomes very low, amplifier devices $Q_1$ and $Q_2$ might enter sub-threshold region, which might increase the output voltage variation. This can be resolved by changing the mode of operation and switching off the larger amplifier device $Q_1$. For a lower current, current source $I_1$ can be shut down and larger amplifier device $Q_1$ can be turned off by activating switch $S_1$, which connects the gate of $Q_1$ to voltage input signal $V_{IN}$. Doing this turns off the larger first amplifier tier and leaves on the smaller second amplifier tier. If a larger current is subsequently desired, the first amplifier tier can be turned back on by deactivating switch $S_1$ and powering on current source $I_1$.

Any number of tiers can be used, if die area does not present a limitation. For example, three amplifier tiers can be used by adding one more tier to operational amplifier 1500 of FIG. 15, according to an embodiment of the present invention. The three amplifier devices used (e.g., $Q_1$, $Q_2$, and additional $Q_3$) can all be of different sizes. For example, $Q_1$ can be a large amplifier device, $Q_2$ can be a medium-sized amplifier device, and $Q_3$ can be a small amplifier device. Different combinations of amplifier tiers can be used to provide controlled output current (and therefore controlled power consumption). For example, all of the amplifier tiers can be used for a large current (high current mode), the second and third amplifier tiers can be used for a medium current (medium current mode), and the third amplifier tier can be used for a low current (low current mode). Other combinations are also possible.

Figure 17:
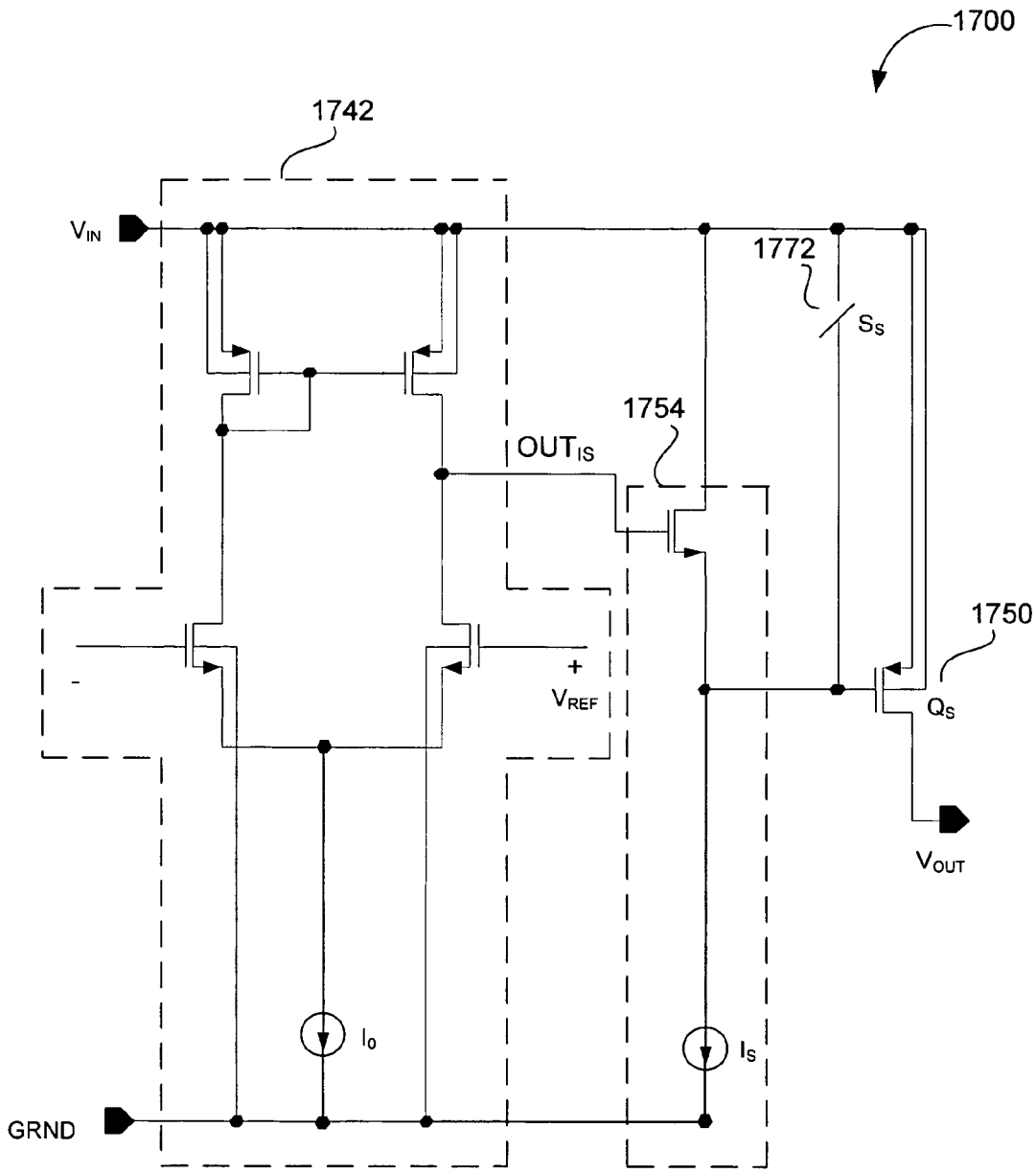
FIG. 17 is a schematic diagram of an operational amplifier with a small amplification device, according to an embodiment of the present invention.

In yet another embodiment involving the programming of LDO output current, multiple operational amplifiers can be used in parallel. For example, the operational amplifier shown in FIG. 15 might have current source $I_0$ generating approximately 8 micro-amps, which in some cases could be considered fairly high. Therefore, a second operational amplifier with a current source $I_0$ generating approximately 1-2 micro-amps, for example, can be placed in parallel with the first operational amplifier. The second operational amplifier, to be used for a smaller current, can have one or more very small amplifier devices. Either or both operational amplifiers can include multiple amplifier tiers that can be switched in or out for further programming capability. An example of an operational amplifier for programming a very small current is shown in FIG. 17 as operational amplifier 1700. Operational amplifier 1700 includes an input stage 1742, a very small amplifier device 1750 ($Q_S$), a source follower circuit 1754, and a switch 1772 ($S_S$). In an embodiment, operational amplifier 1500 can be used for higher current modes and operational amplifier 1700 placed in parallel can be used for the low current mode.

Figure 18:
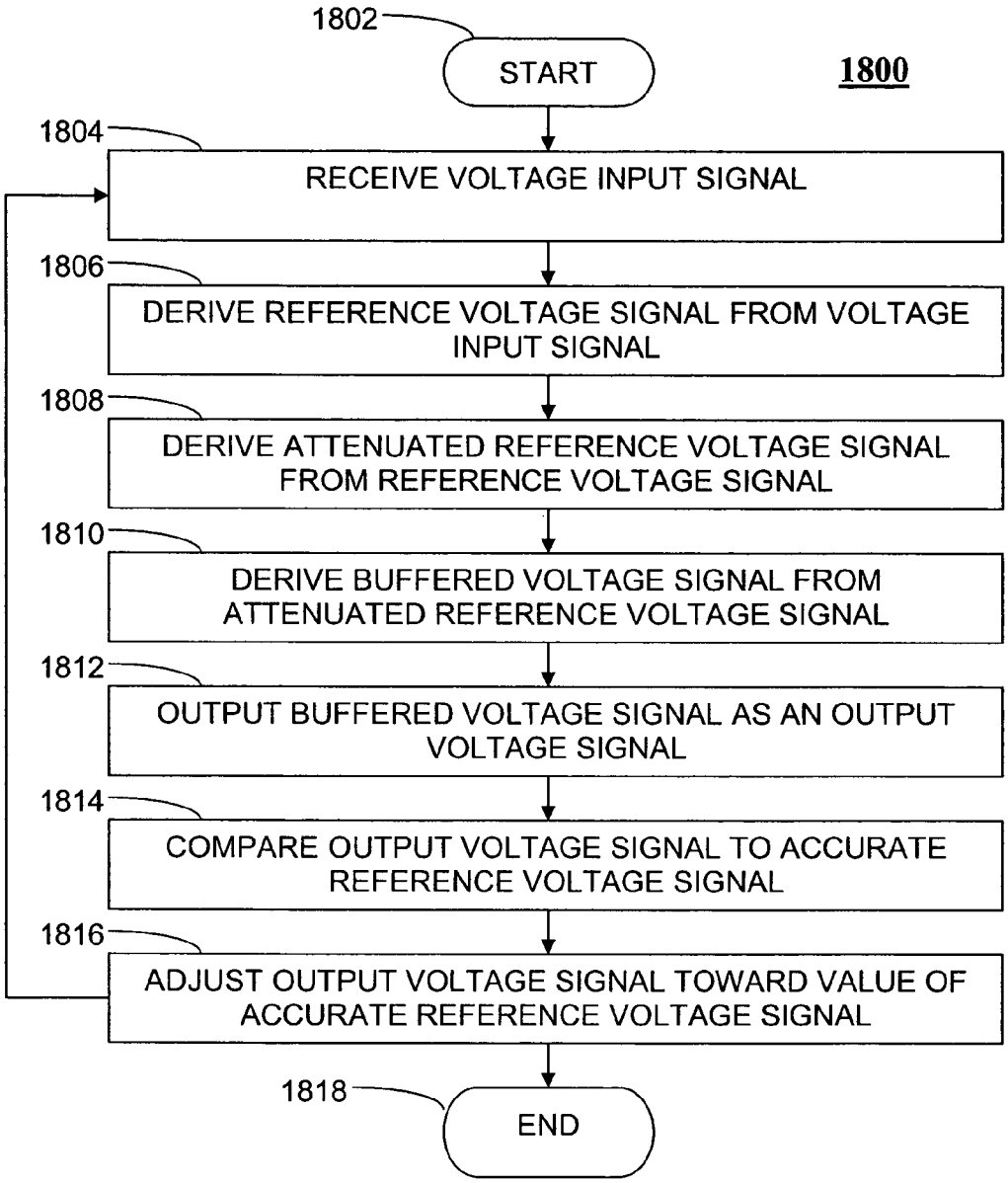
FIG. 18 is a flowchart of a method of regulating voltage in a low-drop-out voltage regulator, according to an embodiment of the present invention.

FIG. 18 is a flowchart of a method 1800 for regulating voltage in an LDO, according to an embodiment of the present invention. Method 1800 begins at step 1802 and immediately proceeds to step 1804. In step 1804, a voltage input signal is received, such as voltage input $V_{IN}$ is received at local reference generator 1612 of FIG. 16, for example. In step 1806, a reference voltage signal is derived from the voltage input signal. For example, reference voltage signal $V_{REF}$ is derived from voltage input signal $V_{IN}$ at local reference generator 1612. In step 1808, an attenuated reference voltage signal is derived from the reference voltage signal, such as attenuated reference voltage signal $V_A$ is derived from reference voltage signal $V_{REF}$ at attenuator 1615, for example. In step 1810, a buffered voltage signal is derived from the attenuated reference voltage signal. The buffered voltage signal is output as an output voltage signal in step 1812. This is similar to output voltage signal $V_{OUT}$ being derived from attenuated reference voltage signal $V_A$ and output from buffer circuit 1614, for example. In step 1814, the output voltage signal is compared to an accurate reference voltage signal, similar to $V_{OUT}$ being compared to REF by a comparison device 510 in FIG. 5. In step 1816, the output voltage signal is adjusted toward the value of the accurate reference voltage signal. Method 1800 is repeated starting at step 1804, or method 1800 can terminate at step 1818, e.g., if power to the LDO is turned off.

Figure 19:
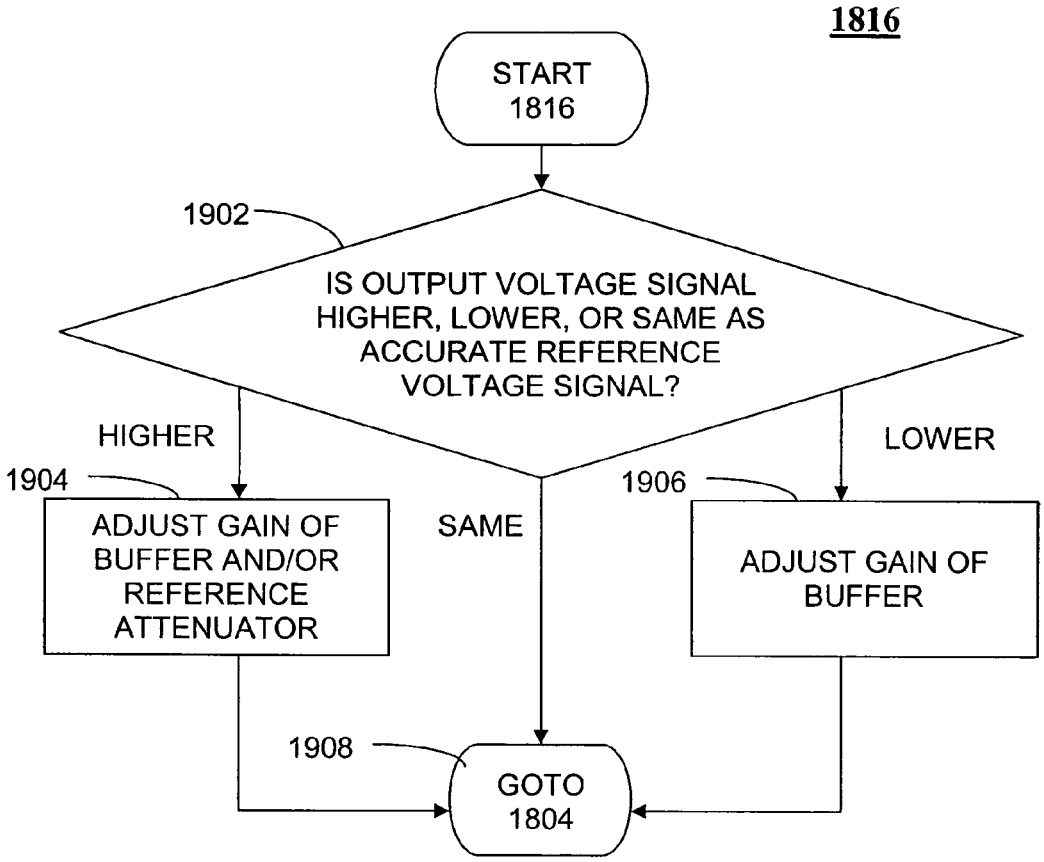
FIG. 19 is a flowchart depicting method step 1816 of FIG. 18, according to an embodiment of the present invention.

FIG. 19 is a flowchart depicting method step 1816 of FIG. 18, according to an embodiment of the present invention. Method 1816 begins at step 1902, where it is determined whether the output voltage signal is higher, lower, or the same as the accurate reference voltage signal. If the output voltage signal is higher than the accurate reference voltage signal, method 1816 proceeds to step 1904 where a gain of a buffer or reference attenuator is adjusted. This can be accomplished by adjusting resistors $R_1$, $R_2$, $R_3$, and/or $R_4$ in attenuator circuit 1615 and buffer circuit 1614 of FIG. 16, for example. If the output voltage signal is lower than the accurate reference voltage signal, method 1816 proceeds to step 1906 where a gain of the buffer is adjusted. This can be accomplished by adjusting resistors $R_1$ and $R_2$ in buffer circuit 1614 of FIG. 16, for example. After step 1904 or step 1906, method 1816 proceeds to step 1908, returning to method 1800 at step 1804. If the output voltage signal is the same as the accurate reference voltage signal, no adjustment is needed, and method 1816 can proceed to step 1908, returning to method 1800 at step 1804.

Figure 20:
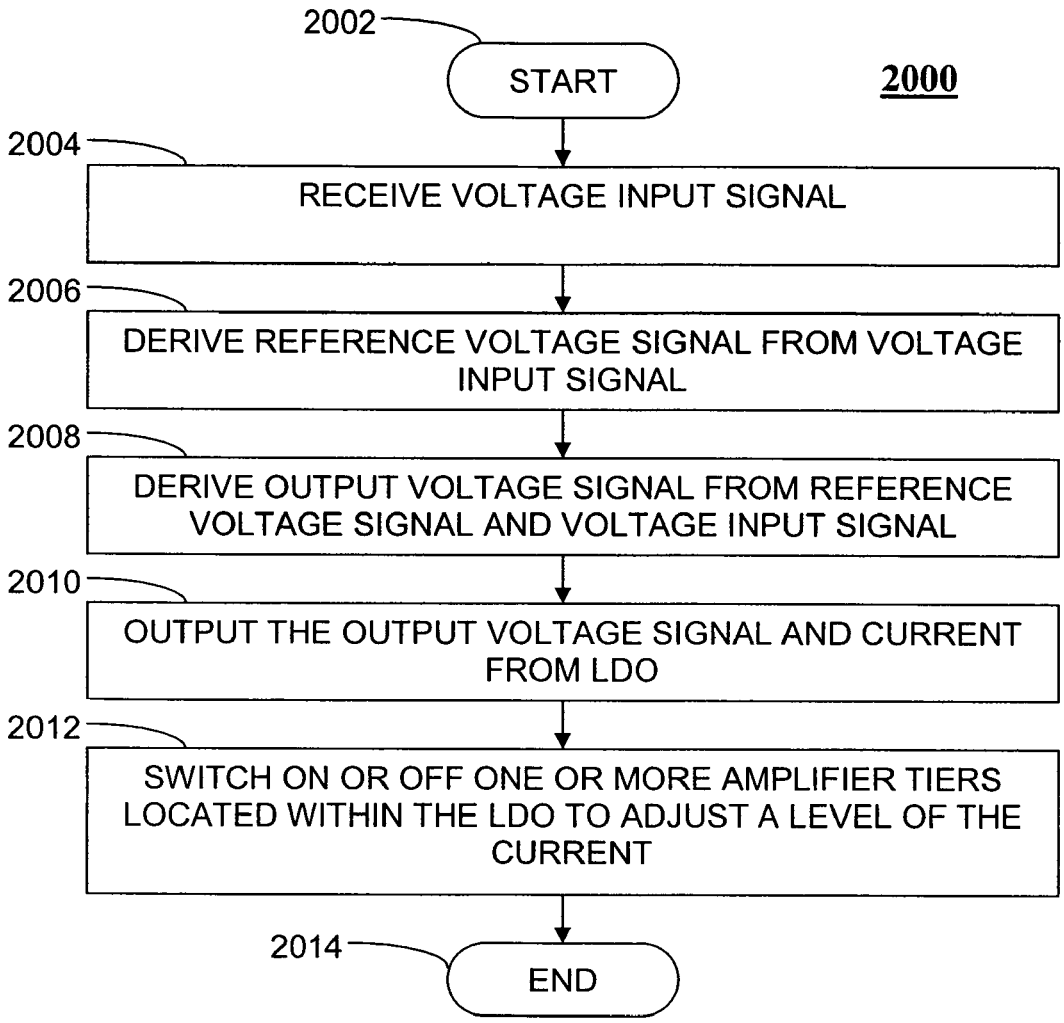
FIG. 20 is a flowchart of a method of programming current consumption in a low-drop-out voltage regulator, according to an embodiment of the present invention.

FIG. 20 is a flowchart of a method 2000 for programming current consumption in an LDO, according to an embodiment of the present invention. Method 2000 begins at step 2002 and immediately proceeds to step 2004. In step 2004, a voltage input signal is received, such as in step 1804 of FIG. 18, for example. In step 2006, a reference voltage signal is derived from the voltage input signal, such as in step 1806 of FIG. 18, for example. In step 2008, an output voltage signal is derived from the reference voltage signal and the voltage input signal, such as output voltage signal $V_{OUT}$ is derived from reference voltage signal $V_{REF}$ and voltage input signal $V_{IN}$ in operational amplifier 1500 of FIG. 15, for example. In step 2010, the output voltage signal and current are output from the LDO. In step 2012, one or more amplifier tiers in the LDO are switched on or off to adjust a level of the current. For example, operational amplifier 1500 of FIG. 15 includes two such amplifier tiers that can be switched in or out to adjust the output current level. Method 2000 terminates at step 2014.

Figure 21:
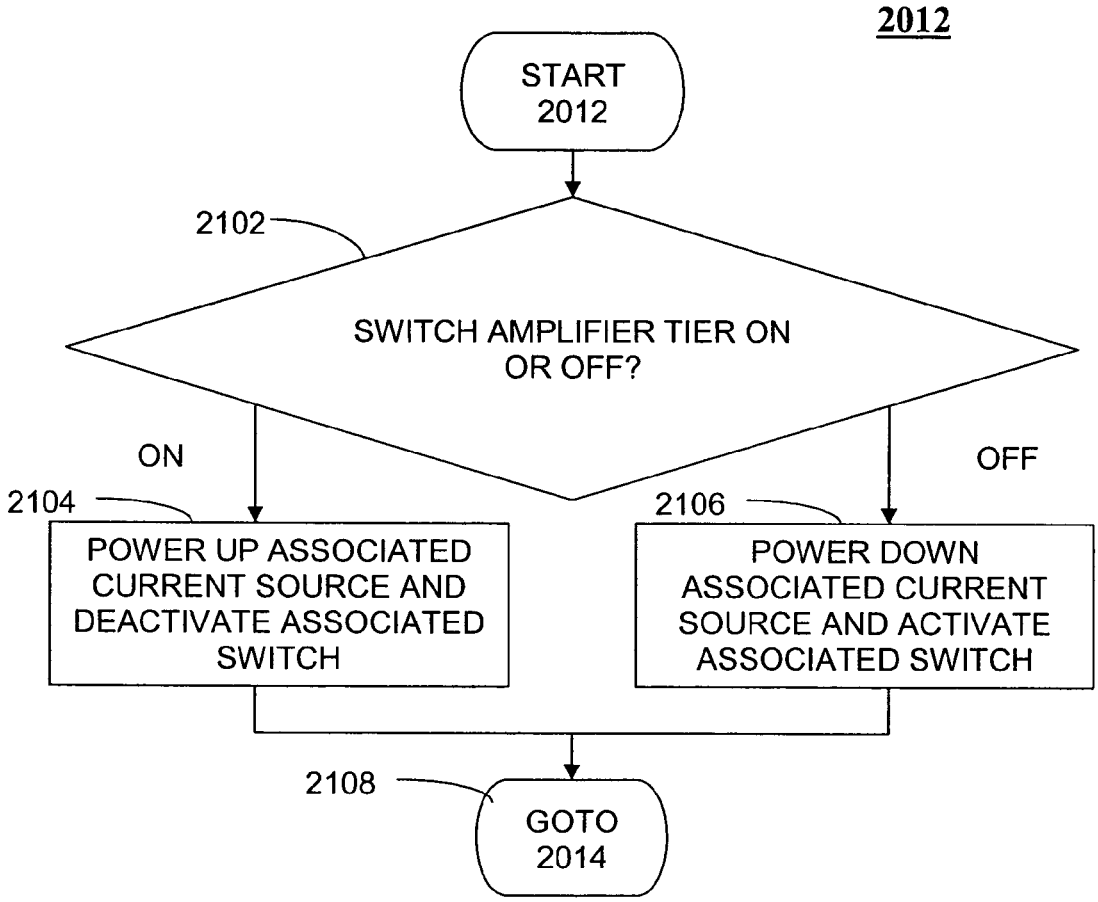
FIG. 21 is a flowchart depicting method step 2012 of FIG. 20, according to an embodiment of the present invention.

FIG. 21 is a flowchart depicting method step 2012 of FIG. 20, according to an embodiment of the present invention. Method 2012 begins at step 2102, where it is determined whether to turn a particular amplifier tier on or off. If the amplifier tier is to be turned on, method 2012 proceeds to step 2104, where a current source associated with the amplifier tier is powered up and a switch associated with the amplifier tier is deactivated. If the amplifier tier is to be turned off, method 2012 proceeds to step 2106, where a current source associated with the amplifier tier is powered down and a switch associated with the amplifier tier is activated. After step 2104 or step 2106, method 2012 proceeds to step 2108, returning to method 2000 at step 2014.

The above description presents various embodiments of a low-drop-out voltage regulator. One embodiment involves using a small, low-current LDO of mediocre accuracy but providing an accurate reference voltage source, external to the LDO, for comparison and tuning (calibration) of the LDO output voltage, which allows greater accuracy without costly power consumption. In embodiments of the invention, the tuning of the LDO output voltage involves adjusting resistors in the LDO's buffer circuit and/or an attenuator located after the LDO's local reference generator, providing flexibility in the adjustment of the output voltage. Programming of the LDO output voltage can be accomplished similarly. In further embodiments of the invention, the output current of the LDO is programmed to control the output current (and therefore power consumption) of the LDO and the LDO's stability by switching in or out amplifier tiers located in the operational amplifier of the LDO's buffer circuit.

As mentioned throughout the above description, the LDO embodiments described above provide various advantages. One advantage is that accurate voltage regulation can be provided without the cost of a large die area and high power consumption. Another advantage is the flexibility in the adjustment and/or programming of the output regulated voltage. Further advantages include the ability to program the output voltage over a large range (e.g., from 0.5 times a nominal output regulated voltage to the nominal output regulated voltage) and the ability to trim (or tune) the nominal output voltage with a high accuracy (e.g., 1%). Still another advantage is the capability of providing differing modes of operation depending on how much current is needed at the output. A person skilled in the pertinent art(s) will recognize further advantages.

While various embodiments of the present invention have been described above, it should be understood that they have been presented by way of example only, and not limitation. It will be apparent to persons skilled in the relevant art(s) that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

It is to be appreciated that the Detailed Description section, and not the Summary and Abstract sections, is intended to be used to interpret the claims. The Summary and Abstract sections may set forth one or more, but not all exemplary embodiments of the present invention as contemplated by the inventor, and thus, are not intended to limit the present invention and the appended claims in any way.

What is claimed is:

1. A low-drop-out voltage regulator (LDO), comprising:

a local reference generator circuit that receives a voltage input signal ($V_{IN}$) and outputs a reference voltage signal ($V_{REF}$);

a buffer circuit that receives the reference voltage signal ($V_{REF}$) and outputs an output voltage signal ($V_{OUT}$) at an LDO output, the buffer circuit having an operational amplifier with a positive input terminal, a negative input terminal, and an output, the operational amplifier output coupled to the LDO output and the operational amplifier having an input stage that receives the reference voltage signal ($V_{REF}$) and the voltage input signal ($V_{IN}$), the input stage comprising a voltage input transistor pair, including a first voltage input transistor and a second voltage input transistor, the voltage input transistor pair having sources coupled to each other and to an accurate reference voltage signal input and having gates coupled to each other and to a drain of the first voltage input transistor;

an input terminal transistor pair, including a first input terminal transistor and a second input terminal transistor, the first input terminal transistor having a gate and a drain coupled together at the negative input terminal and also coupled to the first voltage input transistor drain, and the second input terminal transistor having a gate coupled to the positive input terminal and a drain coupled to a drain of the second voltage input transistor; and a current source, having a first end coupled to sources of the first and second input terminal transistors and having a second end coupled to ground;

an attenuator circuit located between the local reference generator circuit and the buffer circuit; and a comparison device that receives the output voltage signal ($V_{OUT}$) and an accurate reference voltage signal (REF), compares the output voltage signal ($V_{OUT}$) to the accurate reference voltage signal (REF), and outputs an adjustment signal that signifies tuning necessary in the LDO to adjust output voltage signal ($V_{OUT}$) in the direction of a value of the accurate reference voltage signal (REF), wherein a gain of the buffer circuit is adjusted if the output voltage signal ($V_{OUT}$) has a value lower than the accurate reference voltage signal (REF); and wherein at least one of a gain of the attenuator circuit and a gain of the buffer circuit is adjusted if the output voltage signal ($V_{OUT}$) has a value higher than the accurate reference voltage signal (REF).

2. The low-drop-out voltage regulator (LDO) of claim 1, wherein the accurate reference voltage signal (REF) is from an accurate reference voltage source located on a chip that includes the LDO.

3. The low-drop-out voltage regulator (LDO) of claim 1, wherein the accurate reference voltage signal (REF) is from an accurate reference voltage source located external to a chip that includes the LDO.

4. The low-drop-out voltage regulator (LDO) of claim 1, wherein the comparison device is a comparator.

5. The low-drop-out voltage regulator (LDO) of claim 1, wherein the comparison device is an analog-to-digital converter.

6. The low-drop-out voltage regulator (LDO) of claim 1, wherein the attenuator circuit comprises:

one or more first resistors in series with each other such that an initial resistor of the one or more first resistors is coupled to the local reference generator and a last resistor of the one or more first resistors is coupled to the buffer circuit; and one or more second resistors in series with each other such that an initial resistor of the one or more second resistors is coupled to the last resistor of the one or more first resistors and a last resistor of the one or more second resistors is coupled to ground.

7. The low-drop-out voltage regulator (LDO) of claim 6, wherein the output voltage signal ($V_{OUT}$) is programmable depending on values chosen for each of the one or more first resistors and each of the one or more second resistors.

8. The low-drop-out voltage regulator (LDO) of claim 6, further comprising:

a plurality of switches, wherein each switch of the plurality of switches corresponds to a corresponding one of the one or more first resistors and the one or more second resistors, wherein the output voltage signal ($V_{OUT}$) is programmable by switching in or out a select subset of the one or more first resistors and the one or more second resistors using corresponding switches of the plurality of switches.

9. The low-drop-out voltage regulator (LDO) of claim 1, wherein the buffer circuit further comprises:

one or more first resistors in series with each other such that an initial resistor of the one or more first resistors is coupled to the negative input terminal and a last resistor of the one or more first resistors is coupled to the operational amplifier output; and one or more second resistors in series with each other such that an initial resistor of the one or more second resistors is coupled to the negative input terminal and a last resistor of the one or more second resistors is coupled to ground, wherein the reference voltage signal ($V_{REF}$) is received at the positive input terminal and the output voltage signal ($V_{OUT}$) is output at the operational amplifier output.

10. The low-drop-out voltage regulator (LDO) of claim 9, wherein the output voltage signal ($V_{OUT}$) is programmable depending on values chosen for each of the one or more first resistors and each of the one or more second resistors.

11. The low-drop-out voltage regulator (LDO) of claim 9, further comprising:

a plurality of switches, wherein each switch of the plurality of switches corresponds to a corresponding one of the one or more first resistors and the one or more second resistors, wherein the output voltage signal ($V_{OUT}$) is programmable by switching in or out a select subset of the one or more first resistors and the one or more second resistors using corresponding switches of the plurality of switches.

12. The low-drop-out voltage regulator (LDO) of claim 1, wherein the operational amplifier further comprises:

an amplifier device coupled to the input stage and the operational amplifier output; and a load device having a first end coupled to the amplifier device and to the operational amplifier output and having a second end coupled to ground.

13. The low-drop-out voltage regulator (LDO) of claim 12, wherein the operational amplifier further comprises:

a source follower circuit coupled to the input stage and amplifier device.

14. The low-drop-out voltage regulator (LDO) of claim 12, wherein the amplifier device comprises:

an amplifier transistor having a source coupled to the sources of the first and second voltage input transistors and having a gate and drain coupled to each other and to the drains of the second voltage input transistor and the second input terminal transistor.

15. The low-drop-out voltage regulator (LDO) of claim 14, wherein the operational amplifier further comprises a source follower circuit located between the input stage and the amplifier device, the source follower circuit including:

a source follower transistor having a gate coupled to the drains of the second voltage input transistor and the second input terminal transistor and having a drain coupled to the sources of the first voltage input transistor, the second voltage input transistor, and the amplifier transistor; and a second current source having a first end coupled to a source of the source follower transistor and to the amplifier transistor gate and having a second end coupled to ground.

16. The low-drop-out voltage regulator (LDO) of claim 1, wherein the operational amplifier further comprises:

one or more amplifier tiers in parallel with each other and coupled to the input stage and the operational amplifier output.

17. The low-drop-out voltage regulator (LDO) of claim 16, wherein the operational amplifier further comprises:

a resistor-capacitor combination coupled between the input stage and the operational amplifier output such that the resistor-capacitor combination is in parallel with the one or more amplifier tiers, whereby circuit stability of the LDO is provided.

18. The low-drop-out voltage regulator (LDO) of claim 16, wherein each of the one or more amplifier tiers carries a corresponding current, and wherein an accumulation of the corresponding currents creates a cumulative current programmable by switching in or out one or more of the one or more amplifier tiers.

19. The low-drop-out voltage regulator (LDO) of claim 16, wherein each of the one or more amplifier tiers comprises:

a source follower circuit including a source follower transistor coupled to the input stage at a gate and a drain of the source follower transistor, and including a current source having a first end coupled to a source of the source follower transistor and having a second end coupled to ground;

an amplifier transistor having a source coupled to the source follower transistor drain, a gate coupled to the source follower transistor source, and a drain coupled to the operational amplifier output; and a switch having a first end coupled to the source follower transistor drain and the amplifier transistor source, and having a second end coupled to the source follower transistor source and the amplifier transistor gate, wherein the current source and switch are activated or deactivated depending on the amount of current desired at the operational amplifier output, such that when the current source is deactivated and the switch is activated, the amplifier transistor is off, and when the current source is activated and the switch is deactivated, the amplifier transistor is on.

20. The low-drop-out voltage regulator (LDO) of claim 19, wherein the corresponding amplifier transistor of each of the one or more amplifier tiers is of a different size such that the size of each amplifier transistor corresponds to a current amount range.

21. A method of regulating a voltage in a low-drop-out voltage regulator (LDO), comprising:

receiving a voltage input signal ($V_{IN}$);

deriving a reference voltage signal ($V_{REF}$) from the voltage input signal ($V_{IN}$);

deriving an attenuated reference voltage signal ($V_A$) from the reference voltage signal ($V_{REF}$) via an attenuator circuit located between a source of the reference voltage signal and a buffer circuit;

deriving a buffered voltage signal at the buffer circuit from the attenuated reference voltage signal, the buffer circuit having an operational amplifier with a positive input terminal, a negative input terminal, and an output, the operational amplifier output coupled to an LDO output and the operational amplifier having an input stage that receives the reference voltage signal ($V_{REF}$) and the voltage input signal ($V_{IN}$), the input stage comprising a voltage input transistor pair, including a first voltage input transistor and a second voltage input transistor, the voltage input transistor pair coupled to an accurate reference voltage signal input;

an input terminal transistor pair, including a first input terminal transistor and a second input terminal transistor, the first input terminal transistor coupled to the negative input terminal and also to the first voltage input transistor, and the second input terminal transistor coupled to the positive input terminal and to the second voltage input transistor; and a current source, having a first end coupled to the first and second input terminal transistors and having a second end coupled to ground;

outputting the buffered voltage signal as an output voltage signal ($V_{OUT}$);

comparing the output voltage signal ($V_{OUT}$) to an accurate reference voltage signal (REF); and adjusting the output voltage signal ($V_{OUT}$) toward a value of the accurate reference voltage signal (REF) via at least one of the attenuator circuit and the buffer circuit.

22. The method of claim 21, wherein the adjusting step comprises at least one of the following steps if the output voltage signal ($V_{OUT}$) has a value higher than the accurate reference voltage signal (REF):

adjusting the attenuated reference voltage signal ($V_A$) by adjusting the gain of the attenuator circuit; and adjusting the buffered voltage signal by adjusting the gain of the buffer circuit.

23. The method of claim 21, wherein the adjusting step comprises:

adjusting the buffered voltage signal by adjusting the gain of the buffer circuit if the output voltage signal ($V_{OUT}$) has a value lower than the accurate reference voltage signal (REF).

24. A method of programming current consumption in a low-drop-out voltage regulator (LDO), comprising:

receiving a voltage input signal ($V_{IN}$);

deriving a reference voltage signal ($V_{REF}$) from the voltage input signal ($V_{IN}$);

deriving an output voltage signal ($V_{OUT}$) from the reference voltage signal ($V_{REF}$) and the voltage input signal ($V_{IN}$);

outputting the output voltage signal ($V_{OUT}$) and a current from the LDO; and switching on or off one or more amplifier tiers located within the LDO to adjust a level of the current by powering up an associated current source and deactivating an associated switch to turn on an associated one of the amplifier tiers thereby causing a level of the current to decrease, or powering down the associated current source and activating the associated switch to turn off the associated one of the amplifier tiers thereby causing a level of the current to increase.

25. The method of claim 24, wherein the switching step comprises:

switching on or off one or more of the amplifier tiers such that an amount of change in a level of the current caused by switching on or off a particular amplifier tier depends on a size of an amplifier device located within the particular amplifier tier.

26. A low-drop-out voltage regulator (LDO), comprising:

a local reference generator circuit that receives a voltage input signal ($V_{IN}$) and outputs a reference voltage signal ($V_{REF}$);

a buffer circuit that receives the reference voltage signal ($V_{REF}$) and outputs an output voltage signal ($V_{OUT}$) at an LDO output, the buffer circuit having an operational amplifier with a positive input terminal, a negative input terminal, and an output, the operational amplifier output coupled to the LDO output and having an input stage that receives the reference voltage signal ($V_{REF}$) and the voltage input signal ($V_{IN}$); and one or more amplifier tiers in parallel with each other and coupled to the input stage and the operational amplifier output, wherein each of the one or more amplifier tiers comprises a source follower circuit including a source follower transistor coupled to the input stage and a current source having a first end coupled to the source follower transistor and having a second end coupled to ground;

an amplifier transistor coupled to the source follower transistor and the operational amplifier output; and a switch coupled to the source follower transistor and the amplifier transistor, wherein the current source and switch are activated or deactivated depending on the amount of current desired at the operational amplifier output, such that when the current source is deactivated and the switch is activated, the amplifier transistor is off, and when the current source is activated and the switch is deactivated, the amplifier transistor is on;

an attenuator circuit located between the local reference generator circuit and the buffer circuit; and a comparison device that receives the output voltage signal ($V_{OUT}$) and an accurate reference voltage signal (REF), compares the output voltage signal ($V_{OUT}$) to the accurate reference voltage signal (REF), and outputs an adjustment signal that signifies tuning necessary in the LDO to adjust output voltage signal ($V_{OUT}$) in the direction of a value of the accurate reference voltage signal (REF), wherein a gain of the buffer circuit is adjusted if the output voltage signal ($V_{OUT}$) has a value lower than the accurate reference voltage signal (REF); and wherein at least one of a gain of the attenuator circuit and a gain of the buffer circuit is adjusted if the output voltage signal ($V_{OUT}$) has a value higher than the accurate reference voltage signal (REF).

27. The low-drop-out voltage regulator (LDO) of claim 26, wherein:

the source follower transistor has a gate and a drain coupled to the input stage;

the current source first end is coupled to a source of the source follower transistor;

the amplifier transistor has a source coupled to the source follower transistor drain, a gate coupled to the source follower transistor source, and a drain coupled to the operational amplifier output; and the switch has a first end coupled to the source follower transistor drain and the amplifier transistor source, and has a second end coupled to the source follower transistor source and the amplifier transistor gate.

28. The low-drop-out voltage regulator (LDO) of claim 26, wherein the corresponding amplifier transistor of each of the one or more amplifier tiers is of a different size such that the size of each amplifier transistor corresponds to a current amount range.

* * * * *

UNITED STATES PATENT AND TRADEMARK OFFICE

CERTIFICATE OF CORRECTION

PATENT NO. : 7,449,872 B2
APPLICATION NO. : 11/214799
DATED : November 11, 2008
INVENTOR(S) : Alireza Zolfaghari It is certified that error appears in the above-identified patent and that said Letters Patent is hereby corrected as shown below:

In the Title, please correct the title to read as follows:

Low-Power Programmable Low-Drop-Out Voltage Regulator System and Methods

Signed and Sealed this

Tenth Day of February, 2009

John Doll

JOHN DOLL
*Acting Director of the United States Patent and Trademark Office*

UNITED STATES PATENT AND TRADEMARK OFFICE

CERTIFICATE OF CORRECTION

PATENT NO. : 7,449,872 B2
APPLICATION NO. : 11/214799
DATED : November 11, 2008
INVENTOR(S) : Alireza Zolfaghari It is certified that error appears in the above-identified patent and that said Letters Patent is hereby corrected as shown below:

Title Page Item (54) and Column 1, lines 1-3

In the Title, please correct the title to read as follows:

Low-Power Programmable Low-Drop-Out Voltage Regulator System and Methods

This certificate supersedes the Certificate of Correction issued February 10, 2009.

Signed and Sealed this

Tenth Day of March, 2009

John Doll

JOHN DOLL
*Acting Director of the United States Patent and Trademark Office*